US011565299B2

(12) United States Patent
Haga et al.

(10) Patent No.: US 11,565,299 B2
(45) Date of Patent: Jan. 31, 2023

(54) HOT STAMPED PRODUCT, STEEL SHEET FOR HOT STAMP, AND MANUFACTURING METHOD THEREOF

(71) Applicant: NIPPON STEEL CORPORATION, Tokyo (JP)

(72) Inventors: Jun Haga, Tokyo (JP); Kazuo Hikida, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 328 days.

(21) Appl. No.: 16/651,659

(22) PCT Filed: Oct. 2, 2018

(86) PCT No.: PCT/JP2018/036913
§ 371 (c)(1),
(2) Date: Mar. 27, 2020

(87) PCT Pub. No.: WO2019/069938
PCT Pub. Date: Apr. 11, 2019

(65) Prior Publication Data

US 2020/0306812 A1 Oct. 1, 2020

(30) Foreign Application Priority Data

Oct. 2, 2017 (JP) ..... JP2017-193095

(51) Int. Cl.
*B21D 22/02* (2006.01)
*C22C 38/00* (2006.01)
(Continued)

(52) U.S. Cl.
CPC ..... *B21D 22/022* (2013.01); *C21D 8/0226* (2013.01); *C21D 8/0236* (2013.01);
(Continued)

(58) Field of Classification Search
CPC ... C22C 38/001; C22C 38/002; C22C 38/005; C22C 38/02; C22C 38/04; C22C 38/06;
(Continued)

(56) References Cited

U.S. PATENT DOCUMENTS

2010/0221572 A1 9/2010 Laurent et al.
2014/0037980 A1 2/2014 Kawasaki
(Continued)

FOREIGN PATENT DOCUMENTS

CN 102676923 A 9/2012
JP 2002-102980 A 4/2002
(Continued)

OTHER PUBLICATIONS

Kawasaki et al., JP 2005/146354 A machine translation, printed Apr. 15, 2022, Jun. 9, 2005 entire translation (Year: 2005).*
(Continued)

*Primary Examiner* — Humera N. Sheikh
*Assistant Examiner* — Katherine A Christy
(74) *Attorney, Agent, or Firm* — Birch, Stewart, Kolasch & Birch, LLP

(57) ABSTRACT

The entirety or a part of this hot stamped product includes, as a chemical composition, by mass %, C: 0.001% or more and less than 0.080%, Si: 2.50% or less, Mn: 0.01% or more and less than 0.50%, P: 0.200% or less, S: 0.0200% or less, sol.Al: 0.001% to 2.500%, N: 0.0200% or less, Cr: 0.30% or more and less than 2.00%, and a remainder: Fe and impurities, in which a metallographic structure contains, by vol %, ferrite: more than 60.0%, martensite: 0% or more and less than 10.0%, and bainite: 0% or more and less than 20.0%, a tensile strength is less than 700 MPa, and ΔTS, which is a decrease in the tensile strength after a heat treatment at 170° C. for 20 minutes, is 100 MPa or less.

16 Claims, 2 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C21D 8/02*** | (2006.01) |
| ***C21D 9/46*** | (2006.01) |

(52) U.S. Cl.

CPC ..... *C21D 8/0273* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/002* (2013.01); *C21D 2211/005* (2013.01); *C21D 2211/008* (2013.01)

(58) Field of Classification Search

CPC ..... C22C 38/42; C22C 38/44; C22C 38/46; C22C 38/48; C22C 38/50; C22C 38/54; C21D 2211/002; C21D 2211/005; C21D 2211/008; B21D 22/022

USPC ..... 428/544

See application file for complete search history.

(56) References Cited

U.S. PATENT DOCUMENTS

2015/0010775 A1* 1/2015 Nonaka ..... C22C 38/002 148/333
2019/0078172 A1* 3/2019 Kizu ..... C23C 2/06

FOREIGN PATENT DOCUMENTS

| | | | |
|---|---|---|---|
| JP | 2003-328031 | A | 11/2003 |
| JP | 2004-58082 | A | 2/2004 |
| JP | 2005-146354 | A | 6/2005 |
| JP | 2005-193287 | A | 7/2005 |
| JP | 2005-248320 | A | 9/2005 |
| JP | 2009-61473 | A | 3/2009 |
| JP | 5353642 | B2 | 11/2013 |
| JP | 2017-25353 | A | 2/2017 |
| WO | WO 2006/038868 | A1 | 4/2006 |
| WO | WO 2008/132303 | A1 | 11/2008 |
| WO | WO 2012/157581 | A1 | 11/2012 |

OTHER PUBLICATIONS

"Metallic materials—Tensile testing—Method of test at room temperature", JIS Z 2241,2011 (JIS No. 13 B tensile test piece), total 37 pages.

International Search Report for PCT/JP2018/036913 dated Dec. 18, 2018.

Written Opinion of the International Searching Authority for PCT/JP2018/036913 (PCT/ISA/237) dated Dec. 18, 2018.

* cited by examiner

HOT STAMPED PRODUCT, STEEL SHEET FOR HOT STAMP, AND MANUFACTURING METHOD THEREOF

TECHNICAL FIELD OF THE INVENTION

The present invention relates to a hot stamped product, a steel sheet for hot stamp, and a manufacturing method thereof.

Priority is claimed on Japanese Patent Application No. 2017-193095, filed on Oct. 2, 2017, the content of which is incorporated herein by reference.

RELATED ART

Today the industrial technology field is highly divided, and materials used in each technical field are required to have special and high performance. For example, steel sheets for a vehicle are required to have high strength in order to improve fuel efficiency by reducing the weight of the vehicle body in consideration of the global environment. In a case where a high strength steel sheet is applied to the vehicle body of a vehicle, a desired strength can be imparted to the vehicle body while reducing the sheet thickness of the steel sheet and reducing the weight of the vehicle body.

However, in press forming, which is a process for forming a vehicle body member of a vehicle, cracks and wrinkles are more likely to occur as the thickness of the steel sheet used decreases. Therefore, the steel sheet for a vehicle also requires excellent press formability.

Securing the press formability and high-strengthening of the steel sheet are contradictory elements, and it is difficult to satisfy these properties simultaneously. In addition, when a high strength steel sheet is press-formed, the shape of the member is greatly changed by springback that occurs when the member is taken out from the die, so that it is difficult to secure the dimensional accuracy of the member. As described above, it is not easy to manufacture a high strength vehicle body member by press forming.

Hitherto, as a method of manufacturing an ultrahigh-strength vehicle body member, for example, as disclosed in Patent Document 1, a technique for press-forming a heated steel sheet using a low-temperature press die has been proposed. This technique is called hot stamping or hot pressing, and in this technique, a steel sheet which is heated to a high temperature and is thus in a soft state is press-formed. Therefore, a member having a complex shape can be manufactured with high dimensional accuracy. In addition, since the steel sheet is rapidly cooled by contact with the die, it is possible to significantly increase the strength by hardening at the same time as press forming. For example, Patent Document 1 describes that a member having a tensile strength of 1400 MPa or more is obtained by performing hot stamping on a steel sheet having a tensile strength of 500 to 600 MPa.

Meanwhile, among vehicle body members, in frame structure components such as a center pillar and a side member, a hard portion and a soft portion are provided in the member in order to control the deformation state of the member at the time of a collision of a vehicle.

As a method of manufacturing a member having a soft portion by hot stamping, Patent Document 2 discloses a method in which a heating temperature of a steel sheet is partially changed by induction heating or infrared heating in order to soften a portion heated to a low temperature. Patent Document 3 discloses a method in which a heat insulating material is attached to a portion of a steel sheet when the steel sheet is subjected to furnace heating to partially reduce the heating temperature and soften the portion of the steel sheet.

Patent Documents 4 and 5 disclose a method in which the cooling rate of a steel sheet is partially changed by changing the contact area between the steel sheet and a die at the time of forming in order to soften a portion having a low cooling rate. Patent Document 6 discloses a technique of performing hot stamping using a so-called tailored blank material in which two base sheets are connected to each other by welding.

In hot stamping, a steel sheet is usually heated to an austenite region and then cooled at a cooling rate equal to or higher than the critical cooling rate to form a single martensite microstructure for high-strengthening. On the other hand, in the methods described in Patent Documents 2 to 5, as described above, the heating temperature or cooling rate of the steel sheet is partially reduced to generate microstructures other than martensite, thereby softening the steel sheet. However, since the fraction of the microstructures other than martensite changes sensitively in response to the heating temperature and the cooling rate, the methods of Patent Documents 2 to 5 have a problem that the strength of the soft portion is not stable.

Moreover, in the technique described in Patent Document 6, a soft portion can be formed under predetermined heating and cooling conditions by using a steel sheet having low hardenability as one base sheet. However, although the metallographic structure and strength properties of the soft portion greatly depend on the composition of the steel sheet, Patent Document 6 does not provide any consideration for the composition of the steel sheet having low hardenability.

Regarding such problems, Patent Documents 7 and 8 disclose a method of stabilizing the strength of a soft portion in a hot stamped member consisting of a hard portion and a soft portion or a hot stamped member that is soft as a whole.

Specifically, Patent Document 7 discloses a high strength member having strength of 600 to 1200 MPa class for a vehicle and a manufacturing method thereof, in which the C content is reduced and hardening elements are contained in a predetermined amount or more to suppress the formation of ferrite, pearlite, and martensite during cooling. In addition, Patent Document 8 discloses a hot stamped member having a tensile strength of 500 MPa or more and a manufacturing method thereof, in which the C content is limited to a low level and Ti is contained to control the amount of martensite formed.

According to the techniques described in Patent Documents 7 and 8, it is possible to increase the strength and the uniformity of elongation in the member. However, according to the examination by the present inventors, it was found that since the metallographic structure contains hard microstructures such as bainite and martensite, the thermal stability is low, and there are cases where the strength decreases when the member is subjected to a coating baking treatment. Since vehicle members are often subjected to the coating baking treatment, there remains room for improvement in the techniques described in Patent Documents 7 and 8.

PRIOR ART DOCUMENT

Patent Document

[Patent Document 1] Japanese Unexamined Patent Application, First Publication No. 2002-102980

[Patent Document 2] Japanese Unexamined Patent Application, First Publication No. 2005-193287

[Patent Document 3] Japanese Unexamined Patent Application, First Publication No. 2009-61473

[Patent Document 4] Japanese Unexamined Patent Application, First Publication No. 2003-328031

[Patent Document 5] PCT International Publication No. WO2006/38868

[Patent Document 6] Japanese Unexamined Patent Application, First Publication No. 2004-58082

[Patent Document 7] Japanese Unexamined Patent Application, First Publication No. 2005-248320

[Patent Document 8] PCT International Publication No. WO2008/132303

DISCLOSURE OF THE INVENTION

Problems to be Solved by the Invention

As described above, it is not easy to manufacture a soft member or a member including a soft portion by hot stamping, and in particular, it has been difficult in the related art to manufacture a low strength hot stamped member which includes a soft portion partially or entirely and has excellent thermal stability.

An object of the present invention is to solve the above-described problems and provide a hot stamped product which is excellent in thermal stability, and more specifically, has a portion with small fluctuation in strength (tensile strength) before and after a coating baking treatment caused by the coating baking treatment, and a tensile strength of less than 700 MPa, a steel sheet for hot stamp suitable as a material thereof, and a manufacturing method thereof.

Means for Solving the Problem

The present invention has been made in order to solve the above-described problems, and the gist thereof is a hot stamped product, a steel sheet for hot stamp, and a manufacturing method thereof described below.

(1) According to an aspect of the present invention, there is provided a hot stamped product, an entirety or a part of the hot stamped product including, as a chemical composition, by mass %: C: 0.001% or more and less than 0.080%; Si: 2.50% or less; Mn: 0.01% or more and less than 0.50%; P: 0.200% or less; S: 0.0200% or less; sol.Al: 0.001% to 2.500%; N: 0.0200% or less; Cr: 0.30% or more and less than 2.00%; Ti: 0% to 0.300%; Nb: 0% to 0.300%; V: 0% to 0.300%; Zr: 0% to 0.300%; Mo: 0% to 2.00%; Cu: 0% to 2.00%; Ni: 0% to 2.00%; B: 0% to 0.0200%; Ca: 0% to 0.0100%; Mg: 0% to 0.0100%; REM: 0% to 0.1000%; Bi: 0% to 0.0500%; and a remainder: Fe and impurities, in which a metallographic structure contains, by vol %, ferrite: more than 60.0%, martensite: 0% or more and less than 10.0%, and bainite: 0% or more and less than 20.0%, a tensile strength is less than 700 MPa, and ΔTS, which is a decrease in the tensile strength after a heat treatment at 170° C. for 20 minutes, is 100 MPa or less.

(2) In the hot stamped product according to (1), the chemical composition may contain, by mass %, one or more selected from the group consisting of: Ti: 0.001% to 0.300%; Nb: 0.001% to 0.300%; V: 0.001% to 0.300%; and Zr: 0.001% to 0.300%.

(3) In the hot stamped product according to (1) or (2), the chemical composition may contain, by mass %, one or more selected from the group consisting of: Mo: 0.001% to 2.00%; Cu: 0.001% to 2.00%; and Ni: 0.001% to 2.00%.

(4) In the hot stamped product according to any one of (1) to (3), the chemical composition may contain, by mass %, B: 0.0001% to 0.0200%.

(5) In the hot stamped product according to any one of (1) to (4), the chemical composition may contain, by mass %, one or more selected from the group consisting of: Ca: 0.0001% to 0.0100%; Mg: 0.0001% to 0.0100%; and REM: 0.0001% to 0.1000%.

(6) In the hot stamped product according to any one of (1) to (5), the chemical composition may contain, by mass %, Bi: 0.0001% to 0.0500%.

(7) The hot stamped product according to any one of (1) to (6) may further include: a coating layer on a surface.

(8) According to another aspect of the present invention, there is provided a steel sheet for hot stamp including, as a chemical composition, by mass %, C: 0.001% or more and less than 0.080%; Si: 2.50% or less; Mn: 0.01% or more and less than 0.50%; P: 0.200% or less; S: 0.0200% or less; sol.Al: 0.001 to 2.500%; N: 0.0200% or less; Cr: 0.30% or more and less than 2.00%; Ti: 0% to 0.300%; Nb: 0% to 0.300%; V: 0% to 0.300%; Zr: 0% to 0.300%; Mo: 0% to 2.00%; Cu: 0% to 2.00%; Ni: 0% to 2.00%; B: 0% to 0.0200%; Ca: 0% to 0.0100%; Mg: 0% to 0.0100%; REM: 0% to 0.1000%; Bi: 0% to 0.0500%; and a remainder: Fe and impurities, in which a metallographic structure contains iron carbides, and a Mn content and a Cr content in the iron carbides satisfy Formula (i):

$$[Mn]_\theta+[Cr]_\theta>2.5 \quad \text{(i)}$$

where meaning of each symbol in the formula is as follows:

$[Mn]_\theta$: the Mn content (at %) in the iron carbides when a total amount of Fe, Mn, and Cr contained in the iron carbides is 100 at %; and $[Cr]_\theta$: the Cr content (at %) in the iron carbides when the total amount of Fe, Mn, and Cr contained in the iron carbides is 100 at %.

(9) In the steel sheet for hot stamp according to (8), the chemical composition may contain, by mass %, one or more selected from the group consisting of: Ti: 0.001% to 0.300%; Nb: 0.001% to 0.300%; V: 0.001% to 0.300%; and Zr: 0.001% to 0.300%.

(10) In the steel sheet for hot stamp according to (8) or (9), the chemical composition may contain, by mass %, one or more selected from the group consisting of: Mo: 0.001% to 2.00%; Cu: 0.001% to 2.00%; and Ni: 0.001% to 2.00%.

(11) In the steel sheet for hot stamp according to any one of (8) to (10), the chemical composition may contain, by mass %, B: 0.0001% to 0.0200%.

(12) In the steel sheet for hot stamp according to any one of (8) to (11), the chemical composition may contain, by mass %, one or more selected from the group consisting of: Ca: 0.0001% to 0.0100%; Mg: 0.0001% to 0.0100%; and REM: 0.0001% to 0.1000%.

(13) In the steel sheet for hot stamp according to any one of (8) to (12), the chemical composition may contain, by mass %, Bi: 0.0001% to 0.0500%.

(14) The steel sheet for hot stamp according to any one of (8) to (13) may further include: a coating layer on a surface.

(15) According to still another aspect of the present invention, there is provided a manufacturing method of the hot stamped product according to any one of (1) to (6), including: a heating process of heating the steel sheet for hot stamp according to any one of (8) to (13) to a heating temperature T° C.; and a hot stamping process of performing hot stamping on the steel sheet for hot stamp after the heating process.

(16) According to still another aspect of the present invention, there is provided a manufacturing method of the hot stamped product according to any one of (1) to (6), including: a joining process of joining the steel sheet for hot stamp according to any one of (8) to (13) to a steel sheet for joining to form a joined steel sheet; a heating process of heating the joined steel sheet after the joining process to a heating temperature T° C.; and a hot stamping process of performing hot stamping on the joined steel sheet after the heating process.

(17) According to still another aspect of the present invention, there is provided a manufacturing method of the hot stamped product according to (7), including: a heating process of heating the steel sheet for hot stamp according to (14) to a heating temperature T° C.; and a hot stamping process of performing hot stamping on the steel sheet after the heating process.

(18) According to still another aspect of the present invention, there is provided a manufacturing method of the hot stamped product according to (7), including: a joining process of joining the steel sheet for hot stamp according to (14) to a steel sheet for joining to form a joined steel sheet; a heating process of heating the joined steel sheet after the joining process to a heating temperature T° C.; and a hot stamping process of performing hot stamping on the joined steel sheet after the heating process.

(19) In the manufacturing method of the hot stamped product according to any one of (15) to (18), in the heating process, the heating temperature T° C. may be a temperature higher than an $Ac_1$ point of the steel sheet for hot stamp, and in the hot stamping process, a hot stamping start temperature may be a temperature of (T−300°) C. or higher.

(20) According to still another aspect of the present invention, there is provided a manufacturing method of the steel sheet for hot stamp according to any one of (8) to (14), including: a hot rolling process of performing hot rolling on a slab containing, as a chemical composition, by mass %, C: 0.001% or more and less than 0.080%, Si: 2.50% or less, Mn: 0.01% or more and less than 0.50%, P: 0.200% or less, S: 0.0200% or less, sol.Al: 0.001% to 2.500%, N: 0.0200% or less, Cr: 0.30% or more and less than 2.00%, Ti: 0% to 0.300%, Nb: 0% to 0.300%, V: 0% to 0.300%, Zr: 0% to 0.300%, Mo: 0% to 2.00%, Cu: 0% to 2.00%, Ni: 0% to 2.00%, B: 0% to 0.0200%, Ca: 0% to 0.0100%, Mg: 0% to 0.0100%, REM: 0% to 0.1000%, Bi: 0% to 0.0500%, and a remainder: Fe and impurities, and performing coiling in a temperature range of 800° C. or lower to form a hot-rolled steel sheet; and a hot-band annealing process of performing hot-band annealing of heating to a temperature range of higher than 650° C. on the hot-rolled steel sheet to form a hot-rolled annealed steel sheet.

(21) The manufacturing method of the steel sheet for hot stamp according to (20), may further include: a coating process of performing coating after optionally performing either or both of cold rolling and annealing on the hot-rolled annealed steel sheet after the hot-band annealing process.

Effects of the Invention

According to the present invention, it is possible to obtain a hot stamped product which has a portion with small strength fluctuation caused by a coating baking treatment (excellent thermal stability), and a tensile strength of less than 700 MPa.

EMBODIMENTS OF THE INVENTION

Figure 1:
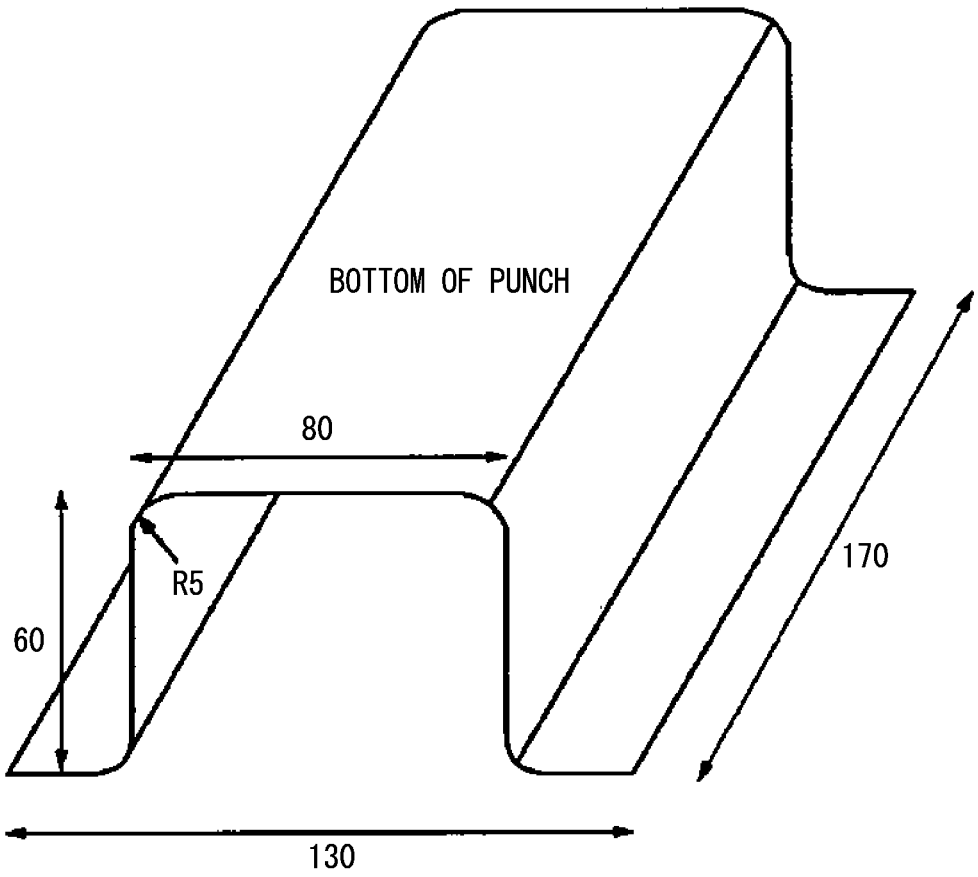
FIG. 1 is a schematic view showing the shape of a hot stamped product manufactured in Example 1.

The present inventors intensively studied a method for suppressing a decrease in strength at the time of a coating baking treatment for a hot stamped product having a tensile strength of less than 700 MPa. As a result, the following knowledge was obtained.

(A) When the metallographic structure of a hot stamped product contains a large amount of hard microstructures such as martensite or bainite, the tensile strength of the formed product is greatly reduced by a coating baking treatment. It is considered that this is because the hard microstructures are tempered and softened.

(B) On the other hand, even with a hot stamped product having a metallographic structure which has a low fraction of hard microstructures and primarily includes a soft microstructure containing ferrite, there are cases where the tensile strength is greatly reduced by a coating baking treatment depending on the composition.

(C) In a hot stamped product having a metallographic structure primarily including a soft microstructure containing ferrite, a reduction in the tensile strength due to a coating baking treatment is suppressed by limiting the Mn content to a low level, including a predetermined amount of Cr, and controlling the Mn content and Cr content in iron carbides in a steel sheet before hot stamping to predetermined levels or more.

The reason for this is not clear. However, it is presumed that (a) when the Mn content is excessive, the transformation temperature from austenite to ferrite decreases, fine iron carbides or fine iron-carbon clusters are generated in ferrite during a cooling process after hot stamping, and the ferrite is hardened, (b) by causing the Mn content and Cr content in iron carbides to be predetermined levels or more and including Cr, the iron carbides are stabilized, and the generation of fine iron carbides or fine iron-carbon clusters in ferrite is suppressed, and (c) fine iron carbides or fine iron-carbon clusters present in ferrite are changed to coarse iron carbides by a heat treatment during coating baking and thus the strength of ferrite is reduced.

From the results of (A) to (C) described above, it was found that by performing hot stamping using a steel sheet for hot stamp in which the Mn content and Cr content in iron carbides are controlled to predetermined levels or more, the Mn content is limited to a low level, and a predetermined amount of Cr or more is included, it is possible to manufacture a hot stamped product which has a metallographic structure primarily containing ferrite, excellent thermal stability, and a small reduction in strength by a coating baking treatment.

Hereinafter, a hot stamped product according to an embodiment of the present invention (a hot stamped product according to the present embodiment), a steel sheet for hot stamp which is suitable as a material thereof (a steel sheet for hot stamp according to the present embodiment), and a manufacturing method thereof will be described in detail.

<Chemical Composition of Hot Stamped Product>

The entirety or a part of the hot stamped product according to the present embodiment has a chemical composition described below. The reasons for limiting each element are as follows. In the following description, "%" in contents means "mass %". In a case where the hot stamped product includes a portion having a tensile strength of less than 700 MPa and another portion having a tensile strength of 700

MPa or more, at least the portion having a tensile strength of less than 700 MPa may have the following chemical composition.

C: 0.001% or More and Less Than 0.080%

C is an element having an effect of increasing the tensile strength of a steel sheet (which is a steel sheet provided in the hot stamped product) after hot stamping. When the C content is less than 0.001%, an increase in the tensile strength due to hot stamping cannot be expected. A preferable C content is 0.010% or more, 0.020% or more, or 0.030% or more.

On the other hand, when the C content is 0.080% or more, the volume percentage of martensite and/or bainite in the metallographic structure of the steel after hot stamping increases, and the tensile strength of the hot stamped product becomes 700 MPa or more. In this case, even if the Mn and Cr contents are adjusted as will be described later, the thermal stability of the hot stamped product cannot be secured. Therefore, the C content is set to less than 0.080%. A preferable C content is less than 0.075%, less than 0.070%, less than 0.060%, or less than 0.050%.

Si: 2.50% or Less

Si is an element contained as an impurity in steel. When the Si content exceeds 2.50%, the weldability deteriorates, the transformation point becomes too high, and it becomes difficult to heat the steel sheet to a temperature equal to or higher than the transformation point during a heating process of the hot stamping. Therefore, the Si content is set to 2.50% or less. A preferable Si content is 2.00% or less, 1.50% or less, or 1.00% or less. In a case where a coated steel sheet is used as the steel sheet for hot stamp, the Si content is set to preferably less than 0.50%, and more preferably less than 0.40% in order to secure coatability.

The lower limit of the Si content is not particularly limited. However, since an excessive reduction in the Si content causes an increase in steelmaking costs, it is preferable that Si is contained in 0.001% or more. In addition, Si has an action of increasing the tensile strength of the steel sheet after hot stamping and thus may be contained positively. From the viewpoint of high-strengthening, a preferable Si content is 0.10% or more, 0.20% or more, or 0.30% or more.

Mn: 0.01% or More and Less Than 0.50%

Mn is an element that deteriorates the thermal stability of the hot stamped product. In particular, when the Mn content is 0.50% or more, the thermal stability of the formed product after hot stamping significantly deteriorates. Therefore, the Mn content is set to less than 0.50%. The Mn content is preferably less than 0.40%, less than 0.35%, less than 0.30%, or less than 0.25%.

On the other hand, Mn is an element that has an action of suppressing the harmful effects of S by being bonded to S as an impurity and forming MnS. In order to obtain this effect, the Mn content is set to 0.01% or more. The Mn content is preferably 0.05% or more, 0.10% or more, or 0.15% or more.

P: 0.200% or Less

P is an element contained in steel as an impurity. When the P content exceeds 0.200%, the weldability and toughness after hot stamping significantly deteriorate, so that the P content is set to 0.200% or less. A preferable P content is 0.100% or less, 0.050% or less, or 0.020% or less.

The lower limit of the P content is not particularly limited. However, since an excessive reduction in the P content causes an increase in steelmaking costs, it is preferable that P is contained in 0.001% or more. In addition, P has an action of increasing the tensile strength of the formed product after hot stamping and thus may be contained positively. From the viewpoint of high-strengthening, a preferable P content is 0.010% or more, 0.020% or more, or 0.030% or more. In a case where a coated steel sheet is used as the steel sheet for hot stamp, the P content is set to preferably 0.05% or less, and more preferably 0.040% or less in order to secure coatability.

S: 0.0200% or Less

S is an element contained in steel as an impurity and embrittles the steel. Therefore, the smaller the S content, the more preferable. However, when the S content exceeds 0.0200%, the adverse effect particularly increases, so that the S content is set to 0.0200% or less. A preferable S content is 0.0100% or less, 0.0050% or less, or 0.0030% or less.

The lower limit of the S content is not particularly limited. However, since an excessive reduction in the S content causes an increase in steelmaking costs, it is preferable that S is contained in 0.0001% or more.

sol.Al: 0.001% to 2.500%

Al is an element having an action of deoxidizing molten steel. When the sol.Al content is less than 0.001%, deoxidation is insufficient. Therefore, the sol.Al content is set to 0.001% or more. The sol.Al content is preferably 0.010% or more, 0.020% or more, or 0.040% or more.

On the other hand, in a case where the sol.Al content is too large, the transformation point rises, and it becomes difficult to heat the steel sheet to a temperature equal to or higher than the transformation point during the heating process of the hot stamping. Therefore, the sol.Al content is set to 2.500% or less. The sol.Al content is preferably 1.000% or less, 0.500% or less, 0.100% or less, or 0.060% or less.

N: 0.0200% or Less

N is an element which is contained in steel as an impurity and forms nitrides during continuous casting of the steel. Since these nitrides deteriorate the toughness after hot stamping, the N content is preferably low. When the N content exceeds 0.0200%, the adverse effect is particularly significant, so that the N content is set to 0.0200% or less. The N content is preferably less than 0.0100%, less than 0.0080%, or less than 0.0050%.

The lower limit of the N content is not particularly limited. However, since an excessive reduction in the N content causes an increase in steelmaking costs, it is preferable that N is contained in 0.001% or more.

Cr: 0.30% or More and Less Than 2.00%

Cr is an element having an action of improving the thermal stability of the hot stamped product (which is the steel sheet after hot stamping) having a metallographic structure primarily containing ferrite. In a case where the Cr content is less than 0.30%, the effect by the above action cannot be sufficiently obtained. Therefore, the Cr content is set to 0.30% or more. The Cr content is preferably 0.50% or more, 0.70% or more, or 0.90% or more.

On the other hand, when the Cr content is 2.00% or more, the volume percentage of martensite and/or bainite contained in the metallographic structure of the hot stamped product becomes excessive, and the thermal stability of the hot stamped product deteriorates. Therefore, the Cr content is set to less than 2.00%. The Cr content is preferably 1.50% or less, 1.20% or less, or 1.00% or less.

Furthermore, the thermal stability of the hot stamped product is improved as the Mn content decreases and the Cr content increases. Therefore, the ratio ([Cr]/[Mn]) between the Cr content ([Cr]) and the Mn content ([Mn]) is preferably set to 1.00 or more. The ratio is more preferably 1.05 or more, 1.50 or more, 2.50 or more, or 3.00 or more.

Ti: 0% to 0.300%

Nb: 0% to 0.300%

V: 0% to 0.300%

Zr: 0% to 0.300%

Ti, Nb, V, and Zr are elements that have an action of increasing the tensile strength of the hot stamped product through refinement of the metallographic structure. In order to obtain this effect, one or more selected from the group consisting of Ti, Nb, V, and Zr may be contained as necessary.

In order to obtain the above effect, it is preferable that one or more selected from the group consisting of Ti, Nb, V, and Zr are each contained in 0.001% or more. Moreover, it is more preferable to include any one or more of 0.005% or more of Ti, 0.005% or more of Nb, 0.010% or more of V, and 0.005% or more of Zr.

In a case where Ti is contained, the Ti content is set to more preferably 0.010% or more, and particularly preferably 0.020% or more. In a case where Nb is contained, the Nb content is set to more preferably 0.020% or more, and particularly preferably 0.030% or more. In a case where V is contained, the V content is more preferably set to 0.020% or more. In a case where Zr is contained, the Zr content is more preferably set to 0.010% or more.

On the other hand, in a case where the each amount of Ti, Nb, V, or Zr exceeds 0.300%, the effect is saturated and the manufacturing costs of the steel sheet increase. Therefore, even in a case where Ti, Nb, V, or Zr is contained, the amounts of Ti, Nb, V, or Zr is each set to 0.300% or less.

Moreover, in a case where the each amount of Ti, Nb, V, and Zr is large, there is concern that carbides of these elements may precipitate in a large amount and the toughness after hot stamping may be impaired. Therefore, the Ti content is preferably less than 0.060%, and more preferably less than 0.040%. The Nb content is preferably less than 0.060%, and more preferably less than 0.040%. The V content is preferably less than 0.200%, and more preferably less than 0.100%. The Zr content is preferably less than 0.200%, and more preferably less than 0.100%.

Mo: 0% to 2.00%

Cu: 0% to 2.00%

Ni: 0% to 2.00%

Mo, Cu, and Ni have an effect of increasing the tensile strength of the hot stamped product (which is the steel sheet after hot stamping). Therefore, one or more selected from the group consisting of Mo, Cu, and Ni may be contained as necessary.

In a case where it is desired to obtain the above effect, it is preferable that one or more selected from the group consisting of Mo, Cu, and Ni are each contained in 0.001% or more. A preferable Mo content is 0.05% or more, a preferable Cu content is 0.10% or more, and a preferable Ni content is 0.10% or more.

On the other hand, when the each amount of Mo, Cu, or Ni exceeds 2.00%, the volume percentage of martensite and/or bainite contained in the metallographic structure of the formed product after hot stamping becomes excessive, and the thermal stability of the hot stamped product deteriorates.

Therefore, even in a case where Mo, Cu, or Ni is contained, the each amount of Mo, Cu, or Ni is set to 2.00% or less. A preferable Mo content is 0.50% or less, a preferable Cu content is 1.00% or less, and a preferable Ni content is 1.00% or less.

B: 0% to 0.0200%

B is an element having an action of segregating at grain boundary and improving the toughness of the steel sheet after hot stamping. In order to obtain this effect, B may be contained as necessary.

In a case where it is desired to obtain the above effect, the B content is preferably 0.0001% or more. The B content is more preferably 0.0006% or more, and even more preferably 0.0010% or more.

On the other hand, in a case where the B content exceeds 0.0200%, the volume percentage of martensite and/or bainite contained in the metallographic structure of the hot stamped product becomes excessive, and the thermal stability of the hot stamped product deteriorates. Therefore, even in a case where B is contained, the B content is set to 0.0200% or less. The B content is preferably 0.0050% or less, and more preferably 0.0030% or less.

Ca: 0% to 0.0100%

Mg: 0% to 0.0100%

REM: 0% to 0.1000%

Ca, Mg, and REM are elements having an effect of improving the toughness after hot stamping by adjusting the shape of inclusions. Therefore, Ca, Mg, and REM may be contained as necessary. In a case where it is desired to obtain the above effect, it is preferable that one or more selected from the group consisting of Ca, Mg, and REM are each contained in 0.0001% or more.

On the other hand, in a case where the amount of Ca or Mg exceeds 0.0100%, or in a case where the amount of REM exceeds 0.1000%, the effect is saturated and excessive costs are incurred. Therefore, even in a case where Ca, Mg, and REM are contained, the Ca and Mg contents are each set to 0.0100% or less, and the REM content is set to 0.1000% or less.

In the present embodiment, REM refers to a total of 17 elements of Sc, Y, and lanthanoids, and the REM content means the total amount of these elements. Lanthanoids are industrially added in the form of mischmetal.

Bi: 0% to 0.0500%

Bi is an element having an effect of improving the toughness after hot stamping by refining a solidification structure. Therefore, Bi may be contained as necessary. In a case where it is desired to obtain the above effect, it is preferable that the Bi content is 0.0001% or more. The Bi content is more preferably 0.0003% or more, and even more preferably 0.0005% or more.

On the other hand, in a case where the Bi content exceeds 0.0500%, the above effects are saturated and excessive costs are incurred. Therefore, even in a case where Bi is contained, the Bi content is set to 0.0500% or less. The Bi content is preferably 0.0100% or less, and more preferably 0.0050% or less.

In the above chemical composition, the remainder is Fe and impurities. Here, "impurities" are elements that are incorporated due to various factors of raw materials such as ores and scraps and manufacturing processes when a steel sheet is industrially manufactured, and are permitted within a range that does not adversely affect the present invention.

<Metallographic Structure of Hot Stamped Product>

The metallographic structure of the hot stamped product according to the present embodiment will be described. The entirety or a part of the hot stamped product according to the present embodiment has a metallographic structure containing ferrite, martensite, and bainite in amounts described below. In the following description regarding the metallographic structure, "%" means "volume percentage %".

Ferrite: More Than 60.0%

When the volume percentage of ferrite is 60.0% or less, the tensile strength of the formed product after hot stamping becomes 700 MPa or more, and thermal stability cannot be secured. Therefore, the volume percentage of ferrite is set to more than 60.0%. The volume percentage of ferrite is preferably more than 70.0%, and more preferably more than 80.0%.

The upper limit of the volume percentage of ferrite does not need to be particularly determined, but is set to preferably less than 98.0%, more preferably less than 96.0%, and even more preferably less than 94.0% in order to increase the strength of the hot stamped product.

The ferrite includes, in addition to polygonal ferrite, pseudo-polygonal ferrite and granular bainitic ferrite having a higher dislocation density than polygonal ferrite, and acicular ferrite having serrated grain boundaries. From the viewpoint of thermal stability, the ratio of polygonal ferrite to the entire ferrite is preferably 10.0% or more by volume percentage.

Martensite: 0% or More and Less Than 10.0%

Bainite: 0% or More and Less Than 20.0%

When the metallographic structure contains martensite and bainite, the thermal stability of the hot stamped product deteriorates. Therefore, the volume percentage of martensite is set to less than 10.0%, and the volume percentage of bainite is set to less than 20.0%. The volume percentage of martensite is set to preferably less than 5.0%, more preferably less than 2.0%, and even more preferably less than 1.0%. The volume percentage of bainite is set to preferably less than 10.0%, more preferably less than 5.0%, and even more preferably less than 2.0%.

Since martensite and bainite are not necessarily contained, the lower limits of the volume percentages of martensite and bainite are both 0%.

However, martensite and bainite have an effect of increasing the strength of the hot stamped product and thus may be contained in the metallographic structure within the above ranges. When the volume percentage of martensite and bainite is less than 0.1%, the effect by the above action cannot be sufficiently obtained. Therefore, in a case of increasing the strength, the lower limits of the volume percentages of martensite and bainite are both set to preferably 0.1% or more, and more preferably 0.5% or more.

The remainder of the metallographic structure may contain pearlite or residual austenite, and may further contain precipitates such as cementite. Since it is not necessary to contain pearlite, residual austenite, and precipitates, the lower limit of the volume percentage of each of pearlite, residual austenite, and precipitates is 0%.

Since pearlite has an effect of increasing the strength of the hot stamped product, in a case of increasing the strength, the volume percentage of pearlite is set to preferably 1.0% or more, more preferably 2.0% or more, and even more preferably 5.0% or more.

On the other hand, in a case where pearlite is excessively contained, the toughness after hot stamping deteriorates. Therefore, the volume percentage of pearlite is set to preferably 20.0% or less, and more preferably 10.0% or less.

Residual austenite has an effect of improving the impact absorbability of the hot stamped product. Therefore, in a case of obtaining this effect, the volume percentage of residual austenite is set to preferably 0.5% or more, and more preferably 1.0% or more.

On the other hand, when residual austenite is excessively contained, the toughness after hot stamping decreases. Therefore, the volume percentage of residual austenite is set to preferably 5.0% or less, and more preferably 3.0% or less.

In the present embodiment, the volume percentage of each metallographic structure is obtained as follows.

First, a test piece is collected from the hot stamped product, and a longitudinal section parallel to the rolling direction of the steel sheet is polished. Thereafter, in a case of a non-coated steel sheet, at a ¼ depth position of the sheet thickness of the steel sheet from the surface of the steel sheet, and in a case of a coated steel sheet, at a ¼ depth position of the sheet thickness of the steel sheet from the boundary between the steel sheet as the substrate and the coating layer, microstructure observation is performed. In a case where the hot stamped product has a portion having a tensile strength of less than 700 MPa and a portion having a tensile strength of 700 MPa or more, the test piece is collected from the portion having a tensile strength of less than 700 MPa and observed.

Specifically, the polished section is etched with nital, microstructure observation is performed using an optical microscope and a scanning electron microscope (SEM), and image analysis is performed on the obtained microstructure photograph, whereby the area ratio of each of ferrite and pearlite, and the total area ratio of bainite, martensite, and residual austenite are obtained. Thereafter, LePera etching was applied to the same observation position, microstructure observation is then performed using the optical microscope and the scanning electron microscope (SEM), and image analysis is performed on the obtained microstructure photograph, whereby the total area ratio of residual austenite and martensite is calculated.

In addition, regarding the same observation position, the longitudinal section is subjected to electrolytic polishing, and then the area ratio of residual austenite is measured using SEM provided with an electron beam backscattering pattern analyzer (EBSP).

Based on these results, the area ratio of each of ferrite, pearlite, bainite, martensite, and residual austenite is obtained. The area ratio is regarded as being the same as the volume percentage, so that the measured area ratio is regarded as the volume percentage of each microstructure.

<Strength of Hot Stamped Product>

The entirety or a part of the hot stamped product according to the present embodiment has a tensile strength of less than 700 MPa in the base steel sheet. This is because when the tensile strength is 700 MPa or more, the thermal stability of the hot stamped product cannot be secured. Preferably, the tensile strength is less than 600 MPa or less than 560 MPa in the entirety or a part of the hot stamped product. On the other hand, in order to improve the impact absorbability of the hot stamped product, the tensile strength of the hot stamped product is set to preferably 440 MPa or more, and more preferably 490 MPa or more.

In the hot stamped product according to the present embodiment, a soft portion having a tensile strength of less than 700 MPa and a hard portion having a tensile strength of 700 MPa or more may be mixed in the formed product. By providing the portions having different strengths, it is possible to control the deformation state of the hot stamped product at the time of a collision, and the impact absorbability of the formed product can be improved. As will be described later, the hot stamped product which has the portions with different strengths can be manufactured by joining two or more kinds of steel sheets having different compositions and performing hot stamping thereon.

<Thermal Stability of Hot Stamped Product>

In the hot stamped product according to the present embodiment, a decrease in tensile strength (ΔTS) from the tensile strength before hot stamping when a heat treatment is performed at 170° C. for 20 minutes, is 100 MPa or less. ΔTS is preferably 60 MPa or less, and more preferably 30 MPa or less.

It is considered that the reason why the strength decreases in the hot stamped product having a microstructure primarily containing ferrite during coating baking is that fine iron carbides or fine iron-carbon clusters present in the ferrite are changed to coarse iron carbides due to a heat treatment during the coating baking. Although it is not easy to directly and quantitatively evaluate the presence state of the fine iron carbides or fine iron-carbon clusters, a decrease in tensile strength (ΔTS) after the heat treatment which is performed at 170° C. for 20 minutes can be indirectly evaluated. When ΔTS is 100 MPa or less, it is determined that the generation of fine iron carbides or fine iron-carbon clusters in the ferrite is suppressed, and the thermal stability is excellent.

<Coating Layer>

The hot stamped product according to the present embodiment may have a coating layer on the surface. By providing the coating layer on the surface, it is possible to prevent the generation of scale during hot stamping and to further improve the corrosion resistance of the hot stamped product. The kind of coating is not particularly limited as long as the above purpose is satisfied. As will be described later, the coating layer of the hot stamped product can be formed by hot stamping using a coated steel sheet. As the kind of the coating layer, a zinc-based coating layer and an aluminum-based coating layer that are hot stamped using a zinc-plated steel sheet or an aluminum-plated steel sheet are exemplary examples.

A steel sheet for hot stamp suitable for manufacturing the above hot stamped product will be described.

<Chemical Composition of Steel Sheet For Hot Stamp>

Since the chemical composition is not substantially changed by hot stamping, the chemical composition of the steel sheet for hot stamp has the same chemical composition as that of the above-described hot stamped product.

<Metallographic Structure of Steel Sheet For Hot Stamp>

The metallographic structure of the steel sheet for hot stamp according to the present embodiment contains iron carbides, and the chemical composition of the iron carbides (the Mn content and Cr content in the iron carbides) satisfies Formula (i).

$$[Mn]_\theta+[Cr]_\theta>2.5 \quad \text{(i)}$$

where the meaning of each symbol in the above formula is as follows.

$[Mn]_\theta$: Mn content (at %) in the iron carbides when the total amount of Fe, Mn, and Cr contained in the iron carbides is 100 at %

$[Cr]_\theta$: Cr content (at %) in the iron carbides when the total amount of Fe, Mn, and Cr contained in the iron carbides is 100 at %

As the chemical composition of the iron carbides contained in the metallographic structure of the steel sheet for hot stamp satisfies Formula (i), the thermal stability of the steel sheet after hot stamping can be improved. The value on the left side of Formula (i) is preferably more than 3.0, and more preferably more than 4.0.

On the other hand, in order to increase the Mn content and the Cr content in the iron carbides, it is necessary to anneal a hot-rolled steel sheet at a high temperature in a hot-band annealing process, which will be described later, and thus the manufacturability of the steel sheet is impaired. Therefore, the value on the left side of Formula (i) is preferably less than 30.0, and more preferably less than 20.0.

In the present embodiment, the chemical composition of the iron carbides is measured by the following procedure.

First, a test piece is collected from any position of the steel sheet, and a longitudinal section parallel to the rolling direction of the steel sheet is polished. Thereafter, precipitates are extracted at a ¼ depth position of the sheet thickness from the surface of the steel sheet by a replica method. These precipitates are observed using a transmission electron microscope (TEM), and identification of the precipitates and composition analysis are performed by electron beam diffraction and energy dispersive X-ray spectroscopy (EDS).

Quantitative analysis of the iron carbides by the EDS is performed on the three elements Fe, Mn, and Cr, and the Mn content (at %) and Cr content (at %) when the total amount of Fe, Mn, and Cr is 100 at % are respectively obtained as $[Mn]_\theta$ and $[Cr]_\theta$. This quantitative analysis is performed on a plurality of iron carbides, and the average value thereof is taken as the Mn content and Cr content in the iron carbides in the steel sheet. The number of iron carbides to be measured is set to 10 or more, and the larger the number of carbides measured, the more preferable. The iron carbides include cementite that is present in isolation in the metallographic structure in addition to cementite contained in pearlite.

In the present embodiment, in a case of a hot-rolled annealed steel sheet, a cold-rolled steel sheet, or an annealed steel sheet, at a ¼ depth position of the sheet thickness from the surface of the steel sheet, and in a case of a coated steel sheet, at a ¼ depth position of the sheet thickness of the steel sheet as the substrate from the boundary between the steel sheet as the substrate and the coating layer, the above-described metallographic structure is specified.

The volume percentage of the iron carbides does not need to be particularly determined. However, in order to increase the tensile strength by refining the metallographic structure after hot stamping, the volume percentage of the iron carbides is set to preferably 1% or more, and more preferably 3% or more.

On the other hand, when the volume percentage of the iron carbides is excessive, the tensile strength of the steel sheet after hot stamping becomes too high and the thermal stability is impaired. Therefore, the volume percentage of the iron carbides is set to preferably 20% or less, and more preferably 15% or less.

The remainder of the metallographic structure of the steel sheet for hot stamp according to the present embodiment primarily contains ferrite, but may contain martensite, tempered martensite, bainite, and residual austenite, and may further contain precipitates other than the iron carbides. However, since martensite, tempered martensite, bainite, and residual austenite deteriorate the toughness after hot stamping, the volume percentages of these microstructures are preferably small. The volume percentages of martensite, tempered martensite, bainite, and residual austenite are all preferably less than 1.0%, and more preferably less than 0.5%.

The volume percentage in the metallographic structure of the steel sheet for hot stamp can be obtained by the same method as in the case of the hot stamped product.

<Manufacturing Methods>

Preferable manufacturing methods of the hot stamped product according to the present embodiment and the steel sheet for hot stamp according to the present embodiment will be described.

[Manufacturing Method of Hot Stamped Product]

A manufacturing method of the hot stamped product according to the present embodiment includes a process of heating a steel sheet for hot stamp having the above-described chemical composition and metallographic structure, and a process of performing hot stamping on the heated steel sheet for hot stamp. In the hot stamping process, cooling and forming are performed by a die, thereby obtaining a hot stamped product.

In the heating process of heating the steel sheet for hot stamp, the heating temperature T (° C.) is preferably set to higher than the $Ac_1$ point. The $Ac_1$ point is the temperature at which austenite starts to form in the metallographic structure when the base steel sheet is heated, and can be obtained from a change in thermal expansion of the steel sheet in the heating process. When the heating temperature is increased, dissolution of carbides is promoted and the strength of the hot stamped product is increased. In a case where the tensile strength of the hot stamped product is set to 440 MPa or more, the heating temperature is set to higher than the $Ac_1$ point.

In order to promote the dissolution of carbides, suppress the generation of martensite or bainite in the metallographic structure of the hot stamped product, and improve the thermal stability of the formed product, the heating temperature is preferably set to higher than the $Ac_3$ point. The $Ac_3$ point is the temperature at which ferrite disappears in the metallographic structure when the steel sheet to be subjected to hot stamping is heated, and can be obtained from a change in thermal expansion of the steel sheet in the heating process.

The upper limit of the heating temperature is not particularly limited. However, when the heating temperature is too high, austenite becomes coarse and the strength of the hot stamped product decreases. Therefore, the heating temperature is preferably 1000° C. or lower, more preferably 950° C. or lower, and even more preferably 900° C. or lower.

In the process of performing hot stamping on the steel sheet, when the heating temperature is referred to as T (° C.), the hot stamping start temperature is preferably set to (T−300°) C. or higher. When the hot stamping start temperature is increased, the reprecipitation of carbides generated before the start of the hot stamping is suppressed, and the strength of the hot stamped product is increased. In a case where the tensile strength of the hot stamped product is set to 440 MPa or higher, the hot stamping start temperature is set to (T−300°) C. or higher. In order to prevent the reprecipitation of carbides, suppress the generation of martensite or bainite in the metallographic structure of the hot stamped product, and improve the thermal stability of the hot stamped product, the hot stamping start temperature is preferably set to higher than the $Ar_3$ point. The $Ar_3$ point is the temperature at which ferrite starts to form in the metallographic structure when the base steel sheet is cooled, and is obtained from a change in thermal expansion when the steel sheet is cooled after the heating process.

Moreover, another manufacturing method of the hot stamped product according to the present embodiment includes a joining process of joining a steel sheet (which is steel sheet for hot stamp) having the above-described chemical composition and metallographic composition to a steel sheet for joining to form a joined steel sheet, a process of heating the joined steel sheet, and thereafter a process of performing hot stamping on the heated joined steel sheet. Regarding the joining, for example, the steel sheet for hot stamp and the steel sheet for joining can be butted or overlapped and joined by welding.

It is preferable that the heating temperature T (° C.) of the joined steel sheet is set to higher than the $Ac_1$ point of the steel sheet for hot stamp, and the hot stamping start temperature is set to (T−300°) C. or higher. In this case, a more preferable heating temperature is higher than the $Ac_3$ point of the steel sheet, and a more preferable hot stamping start temperature is higher than the $Ar_3$ point of the steel sheet. This reason is the same as the case where the joining process is not included.

The chemical composition and mechanical properties of the steel sheet for joining are not particularly limited. However, in order to increase the impact absorbed energy of the hot stamped product, the tensile strength after hot stamping is preferably 700 MPa or more. A more preferable tensile strength after hot stamping is more than 1000 MPa, more than 1200 MPa, or more than 1500 MPa.

In order to secure the tensile strength of the steel sheet for joining after hot stamping, the C content of the steel sheet for joining is preferably 0.080% or more. A preferable lower limit of the C content is 0.100%, 0.120%, or 0.200%. For the same reason, the Mn content of the steel sheet for joining is preferably 0.50% or more. A preferable lower limit of the Mn content is 0.80%, 1.00%, or 1.20%.

The steel sheet (steel sheet for hot stamp) used as the base is preferably subjected to hot-band annealing as will be described later. After the hot-band annealing, cold rolling, or cold rolling and annealing may be further performed. On the other hand, the steel sheet for joining may be any of a hot-rolled steel sheet, a cold-rolled steel sheet obtained by cold rolling a hot-rolled steel sheet, a hot-rolled annealed steel sheet obtained by annealing a hot-rolled steel sheet, and a cold-rolled annealed steel sheet obtained by annealing a cold-rolled steel sheet.

Moreover, in order to improve the corrosion resistance of the hot stamped product, a coated steel sheet of which the surface is coated may be used as the steel sheet for hot stamp and the steel sheet for joining. The kind of coated steel sheet is not particularly limited, but a hot-dip galvanized steel sheet, a hot-dip galvannealed steel sheet, a hot-dip aluminum-coated steel sheet, a hot-dip Zn—Al alloy coated steel sheet, a hot-dip Zn—Al—Mg alloy coated steel sheet, a hot-dip Zn—Al—Mg—Si alloy coated steel sheet, an electrogalvanized steel sheet, an electrolytic Ni—Zn alloy coated steel sheet, and the like are exemplary examples.

[Manufacturing Method of Steel Sheet for Hot Stamp]

The manufacturing method of the steel sheet for hot stamp according to the present embodiment includes a hot rolling process of performing hot rolling on a slab having the above-described chemical composition and performing coiling in a temperature range of 800° C. or lower to form a hot-rolled steel sheet, and a hot-band annealing process of performing hot-band annealing of heating to a temperature range of higher than 650° C. on the hot-rolled steel sheet to form a hot-rolled annealed steel sheet.

In the hot rolling process, the coiling temperature after the hot rolling is set to 800° C. or lower. When the coiling temperature is higher than 800° C., the metallographic structure of the hot-rolled steel sheet becomes excessively coarse, and the tensile strength of the steel sheet after hot stamping decreases. The coiling temperature is preferably lower than 650° C., more preferably lower than 600° C., and even more preferably lower than 550° C.

The hot-rolled and coiled steel sheet is annealed after being subjected to a treatment such as degreasing as necessary according to a known method. Annealing performed on a hot-rolled steel sheet is called hot-band annealing, and a steel sheet after being subjected to the hot-band annealing is called a hot-rolled annealed steel sheet. Before the hot-band annealing, descaling by pickling or the like may be performed.

The heating temperature in the hot-band annealing process is set to higher than 650° C. This is to increase the Mn content and the Cr content in the iron carbides in the metallographic structure of the hot-rolled annealed steel sheet. The heating temperature in the hot-band annealing process is preferably higher than 680° C., and more preferably higher than 700° C. On the other hand, when the heating temperature in the hot-band annealing process becomes too high, the metallographic structure of the hot-rolled annealed steel sheet becomes coarse, and the tensile strength after hot stamping decreases. Therefore, the upper limit of the heating temperature in the hot-band annealing process is preferably lower than 750° C., and more preferably lower than 720° C.

A manufacturing method of the slab provided for the manufacturing method of the steel sheet for hot stamp according to the present embodiment is not particularly limited. In a preferable manufacturing method of the slab exemplified, steel having the above-described composition is melted by a known method, thereafter made into a steel ingot by a continuous casting method, or made into a steel ingot by any casting method, and then made into a steel piece by a blooming method or the like. In the continuous casting process, in order to suppress the occurrence of surface defects due to inclusions, it is preferable to cause an external additional flow by such as electromagnetic stirring to occur in molten steel in a mold. The steel ingot or steel piece may be reheated after being cooled once and subjected to hot rolling, or the steel ingot in a high temperature state after the continuous casting or the steel piece in a high temperature state after the blooming may be subjected to hot rolling as it is, after being kept hot, or after being subjected to auxiliary heating. In the present embodiment, the steel ingot and the steel piece are collectively referred to as a "slab" as the material of hot rolling.

The temperature of the slab to be subjected to hot rolling is set to preferably lower than 1250° C., and more preferably lower than 1200° C. in order to prevent coarsening of austenite. Hot rolling is preferably completed in a temperature range of the $Ar_3$ point or higher in order to refine the metallographic structure of the hot-rolled steel sheet through transforming of austenite after completion of rolling.

In a case where the hot rolling includes rough rolling and finish rolling, the rough-rolled material may be heated between the rough rolling and the finish rolling in order to complete the finish rolling at the above temperature. At this time, it is desirable to suppress temperature fluctuation over the entire length of the rough-rolled material at the start of the finish rolling to 140° C. or lower by performing heating such that the rear end of the rough-rolled material has a higher temperature than the front end. This improves the uniformity of product characteristics in the coil after the coiling process.

A heating method of the rough-rolled material may be performed using a known method. For example, a solenoid induction heating device may be provided between a roughing mill and a finishing mill, and an increase in the heating temperature may be controlled based on the temperature distribution and the like in the longitudinal direction of the rough-rolled material on the upstream side of the induction heating device.

After the hot-band annealing process, the hot-rolled annealed steel sheet may be cold-rolled into a cold-rolled steel sheet. Cold rolling may be performed according to a typical method, and descaling by pickling or the like may be performed before the cold rolling. In the cold rolling, in order to refine the metallographic structure after hot stamping and increase the tensile strength, the cold rolling reduction (cumulative rolling reduction in cold rolling) is set to preferably 30% or more, and more preferably 40% or more. When the cold rolling reduction is too high, the toughness after hot stamping deteriorates, so that the cold rolling reduction is set to preferably 60% or less, and more preferably 50% or less. As will be described later, in a case where annealing is performed after the cold rolling, in order to refine the metallographic structure of the annealed steel sheet, the cold rolling reduction is set to preferably 60% or more, and more preferably 70% or more.

The cold-rolled steel sheet may be annealed and whereby an annealed steel sheet may be obtained. The annealing may be performed according to a typical method, and a treatment such as degreasing may be performed by a known method before the annealing. In order to refine the metallographic structure of the annealed steel sheet by recrystallization, the lower limit of a soaking temperature during the annealing is preferably set to 600° C., 650° C., or 700° C. On the other hand, when the soaking temperature is too high or the soaking time is too long, the metallographic structure of the annealed steel sheet becomes coarse due to grain growth. Therefore, the soaking temperature during the annealing is preferably set to 800° C. or lower, or 760° C. or lower, and the soaking time is preferably set to shorter than 300 seconds or shorter than 120 seconds. The annealing may be performed by either box annealing or continuous annealing method, but from the viewpoint of productivity, continuous annealing is preferable.

The hot-rolled annealed steel sheet, the cold-rolled steel sheet, and the annealed steel sheet obtained as described above may be subjected to temper rolling according to a typical method.

The steel sheet for hot stamp according to the present embodiment may be provided with a coating layer on the surface layer for the purpose of preventing the generation of scale during hot stamping and improving the corrosion resistance of the steel sheet after the hot stamping. The kind of coating is not particularly limited as long as the above-mentioned purpose is satisfied, but a hot-dip galvanized steel sheet, a hot-dip galvannealed steel sheet, a hot-dip aluminum-coated steel sheet, a hot-dip Zn—Al alloy coated steel sheet, a hot-dip Zn—Al—Mg alloy coated steel sheet, a hot-dip Zn—Al—Mg—Si alloy coated steel sheet, an electrogalvanized steel sheet, an electrolytic Ni—Zn alloy coated steel sheet, and the like are exemplary examples.

In a case of manufacturing a hot-dip coated steel sheet, the hot-rolled annealed steel sheet, the cold-rolled steel sheet, or the annealed steel sheet manufactured by the method described above as a base steel sheet may be coated according to a typical method. In a case of using the cold-rolled steel sheet as the base steel sheet, the lower limit of the soaking temperature in the annealing process of continuous hot-dip coating is preferably set to 600° C., 650° C., or 700° C. in order to refine the metallographic structure of the coated steel sheet by recrystallization.

On the other hand, when the soaking temperature is too high, the metallographic structure of the annealed steel sheet becomes coarse due to grain growth. Therefore, regardless of the kind of the base steel sheet, the upper limit of the soaking temperature in the annealing process of continuous hot-dip coating is preferably set to 800° C. or 760° C. An alloying treatment may be performed by reheating the steel sheet after the hot-dip coating.

In a case of manufacturing an electro coated steel sheet, the hot-rolled annealed steel sheet, the cold-rolled steel sheet, or the annealed steel sheet manufactured by the above-described method as a base steel sheet may be subjected to electro coating according to a typical method after being subjected to a known pretreatment for cleaning and adjusting the surface as necessary. The coated steel sheet obtained as described above may be subjected to temper rolling according to a typical method.

Hereinafter, the present invention will be described more specifically with reference to examples, but the present invention is not limited to these examples.

EXAMPLES

Example 1

Molten steel was cast using a vacuum melting furnace to manufacture Steels A to R having the chemical composition shown in Table 1. $Ac_1$ point and $Ac_3$ point in Table 1 were obtained from changes in thermal expansion when the cold-rolled steel sheets of Steels A to R were heated at 2° C./sec. In addition, $Ar_3$ point in Table 1 was obtained from a change in thermal expansion when the cold-rolled steel sheets of Steels A to M were heated to 950° C. and then cooled at 10° C./sec. Steels A to R were heated to 1200° C. and retained for 60 minutes, and then subjected to hot rolling under the hot rolling conditions shown in Table 2.

TABLE 1

| | Chemical composition (mass %, remainder: Fe and impurities) | | | | | | | | | | | |
|---|---|---|---|---|---|---|---|---|---|---|---|---|
| Steel | C | Si | Mn | P | S | sol. AI | N | Cr | Ti | Nb | V | Zr |
| A | 0.051 | 0.11 | 0.32 | 0.011 | 0.0021 | 0.045 | 0.0034 | 0.99 | | | | |
| B | 0.051 | 0.12 | 0.31 | 0.010 | 0.0020 | 0.044 | 0.0035 | 0.98 | 0.015 | | | |
| C | 0.052 | 0.11 | 0.32 | 0.010 | 0.0018 | 0.042 | 0.0034 | 0.98 | 0.029 | 0.031 | | |
| D | 0.051 | 0.11 | 0.32 | 0.012 | 0.0019 | 0.043 | 0.0031 | 0.52 | 0.014 | | | |
| E | 0.090 | 0.10 | 0.30 | 0.011 | 0.0021 | 0.045 | 0.0036 | 1.02 | 0.014 | | | |
| F | 0.050 | 0.10 | 1.02 | 0.010 | 0.0020 | 0.044 | 0.0031 | 0.51 | 0.015 | | | |
| G | 0.071 | 0.11 | 0.31 | 0.011 | 0.0020 | 0.043 | 0.0027 | 0.10 | 0.014 | | | |
| H | 0.052 | 0.12 | 0.30 | 0.011 | 0.0021 | 0.045 | 0.0035 | 0.98 | 0.014 | | | |
| I | 0.051 | 0.11 | 0.32 | 0.012 | 0.0019 | 0.043 | 0.0036 | 0.99 | | | | |
| J | 0.052 | 0.01 | 0.31 | 0.012 | 0.0019 | 0.044 | 0.0034 | 0.98 | | | | |
| K | 0.053 | 0.11 | 0.33 | 0.011 | 0.0021 | 0.043 | 0.0036 | 0.98 | | | | |
| L | 0.052 | 0.11 | 0.33 | 0.010 | 0.0020 | 0.046 | 0.0035 | 0.97 | | | | |
| M | 0.052 | 0.12 | 0.31 | 0.011 | 0.0019 | 0.045 | 0.0044 | 2.03 | | | | |
| N | 0.053 | 0.10 | 0.39 | 0.011 | 0.0021 | 0.045 | 0.0030 | 0.31 | | | 0.011 | 0.010 |
| O | 0.051 | 0.12 | 0.38 | 0.010 | 0.0022 | 0.044 | 0.0035 | 0.65 | | | | |
| P | 0.053 | 0.11 | 0.39 | 0.011 | 0.0020 | 0.045 | 0.0031 | 0.32 | 0.030 | 0.031 | | |
| Q | 0.052 | 0.10 | 0.51 | 0.012 | 0.0020 | 0.044 | 0.0030 | 0.35 | | | | |
| R | 0.051 | 0.10 | 0.42 | 0.011 | 0.0021 | 0.045 | 0.0028 | 0.28 | | | | |

| | Chemical composition (mass %, remainder: Fe and impurities) | | | | | | | | Transformation point (° C.) | | |
|---|---|---|---|---|---|---|---|---|---|---|---|
| Steel | Mo | Cu | Ni | B | Ca | Mg | REM | Bi | $Ac_1$ | $Ac_3$ | $Ar_3$ |
| A | | | | | | | | | 743 | 868 | 803 |
| B | | | | | | | | | 756 | 874 | 810 |
| C | | | | | | | | | 759 | 878 | 818 |
| D | | | | | | | | | 748 | 880 | 827 |
| E | | | | | | | | | 755 | 862 | 792 |
| F | | | | | | | | | 745 | 878 | 778 |
| G | | | | | | | | | 740 | 885 | 829 |
| H | | | | 0.0015 | | | | | 761 | 882 | 776 |
| I | 0.06 | | | | | | | | 749 | 874 | 794 |
| J | | 0.22 | 0.12 | | | | | | 738 | 860 | 795 |
| K | | | | | 0.0006 | 0.0005 | | | 742 | 869 | 806 |
| L | | | | | | | 0.0004 | 0.0022 | 743 | 868 | 810 |
| M | | | | | | | | | 755 | 857 | 781 |
| N | | | | | | | | | 731 | 879 | 830 |
| O | | | | | | | | | 736 | 869 | 817 |
| P | | | | | | | | | 741 | 886 | 828 |
| Q | | | | | | | | | 725 | 870 | 812 |
| R | | | | | | | | | 728 | 875 | 828 |

TABLE 2

| Test No. | Steel | Hot rolling condition: Sheet thickness after rolling (mm) | Hot rolling condition: Coiling temperature (° C.) | Hot-band annealing condition Soaking temperature (° C.) | Cold rolling condition: Sheet thickness after rolling (mm) | Annealing condition Soaking temperature (° C.) |
|---|---|---|---|---|---|---|
| 1 | A | 3.6 | 540 | 710 | 1.4 | — |
| 2 | A | 3.6 | 540 | 710 | 1.4 | 730 |
| 3 | A | 2.0 | 540 | 710 | — | — |
| 4 | A | 3.6 | 540 | 710 | 1.4 | — |
| 5 | A | 3.6 | 540 | 710 | 1.4 | — |
| 6 | A | 3.6 | 540 | 710 | 1.4 | — |
| 7 | B | 3.6 | 540 | 710 | 1.4 | — |
| 8 | B | 3.6 | 540 | 710 | 1.4 | 750 |
| 9 | B | 3.6 | 540 | 710 | 1.4 | — |
| 10 | B | 3.6 | 540 | 710 | 1.4 | — |
| 11 | C | 3.6 | 540 | 710 | 1.4 | — |
| 12 | C | 3.6 | 540 | 710 | 1.4 | 750 |
| 13 | C | 3.6 | 540 | 710 | 1.4 | — |
| 14 | C | 3.6 | 540 | 710 | 1.4 | — |
| 15 | D | 3.6 | 540 | 710 | 1.4 | 730 |
| 16 | E | 3.6 | 540 | 710 | 1.4 | — |
| 17 | F | 3.6 | 540 | 710 | 1.4 | — |
| 18 | G | 3.6 | 540 | 710 | 1.4 | — |
| 19 | H | 3.6 | 540 | 710 | 1.4 | 750 |
| 20 | I | 3.6 | 540 | 710 | 1.4 | 730 |
| 21 | J | 3.6 | 540 | 710 | 1.4 | — |
| 22 | K | 3.6 | 540 | 710 | 1.4 | — |
| 23 | L | 3.6 | 540 | 710 | 1.4 | 730 |
| 24 | M | 3.6 | 490 | — | 1.4 | — |
| 25 | M | 3.6 | 490 | 710 | 1.4 | — |
| 26 | N | 3.6 | 580 | — | 1.4 | — |
| 27 | N | 3.6 | 540 | 710 | 1.4 | — |
| 28 | O | 3.6 | 600 | 620 | 1.4 | 730 |
| 29 | O | 3.6 | 540 | 660 | 1.4 | 730 |
| 30 | P | 3.6 | 580 | — | 1.4 | 750 |
| 31 | P | 3.6 | 540 | 710 | 1.4 | 750 |
| 32 | Q | 3.6 | 600 | — | 1.4 | — |
| 33 | Q | 3.6 | 540 | 710 | 1.4 | — |
| 34 | R | 3.6 | 600 | — | 1.4 | — |
| 35 | R | 3.6 | 540 | 710 | 1.4 | — |

Specifically, Steels A to R were rolled in 10 passes in a temperature range of the $Ar_3$ point or higher into hot-rolled steel sheets having a thickness of 2.0 to 3.6 mm. After the hot rolling, the hot-rolled steel sheet was cooled to 490° C. to 600° C. with water spray, the cooling finishing temperature was taken as a coiling temperature, the hot-rolled steel sheet was charged into an electric heating furnace retained at the coiling temperature and retained for 60 minutes, the hot-rolled steel sheet was then subjected to furnace cooling to room temperature at an average cooling rate of 20° C./hr, and whereby slow cooling after coiling was simulated.

Some of the hot-rolled steel sheets after the slow cooling were subjected to hot-band annealing. Specifically, the hot-rolled steel sheet was heated to 620° C. to 710° C. at an average heating rate of 50° C./hr using the electric heating furnace, retained for 1 hour, and subsequently cooled at an average cooling rate of 20° C./hr, whereby a hot-rolled annealed steel sheet was obtained.

The hot-rolled steel sheet and hot-rolled annealed steel sheet except for Test No. 3 were pickled to obtain base metal for cold rolling, and cold rolling was performed thereon at a rolling reduction of 61%, whereby a cold-rolled steel sheet having a thickness of 1.4 mm was obtained. Some of the cold-rolled steel sheets were heated to 750° C. at an average heating rate of 10° C./sec using a continuous annealing simulator and soaked for 60 seconds. Subsequently, the resultant was cooled to 400° C., retained for 180 seconds, and cooled to room temperature, whereby an annealed steel sheet was obtained.

In addition, some of the cold-rolled steel sheets were heated to a soaking temperature for annealing shown in Table 2 at an average heating rate of 10° C./sec using a hot-dip coating simulator and soaked for 60 seconds. Subsequently, the base steel sheet was cooled and immersed in a hot-dip galvanizing bath or a hot-dip aluminum coating bath to perform hot-dip galvanizing or hot-dip aluminum coating. Some of the base steel sheets were subjected to an alloying treatment by being heated to 520° C. after the hot-dip galvanizing.

From the hot-rolled steel sheet, hot-rolled annealed steel sheet, cold-rolled steel sheet, annealed steel sheet, hot-dip galvanized steel sheet, hot-dip galvannealed steel sheet, and hot-dip aluminum-coated steel sheet (these steel sheets are collectively referred to as steel sheets for hot stamp) obtained as described above, test pieces for microstructure observation were collected, and microstructure observation was performed.

Specifically, in a case of a non-coated steel sheet, from a ¼ depth position of the sheet thickness of the steel sheet from the surface of the steel sheet, and in a case of a coated steel sheet, from a ¼ depth position of the sheet thickness of the steel sheet as the substrate from the boundary between the steel sheet as the substrate and the coating layer, precipitates were extracted by a replica method, and iron carbides were identified using TEM. Ten iron carbides were quantitatively analyzed for the three elements Fe, Mn, and Cr using EDS. When the total amount of Fe, Mn, and Cr was 100 at %, the Mn content (at %) and the Cr content (at %) in the iron carbides were respectively referred to as $[Mn]_\theta$ and $[Cr]_\theta$, and the average value of the sum of $[Mn]_\theta$ and $[Cr]_\theta$ was obtained.

Furthermore, a JIS No. 13 B tensile test piece was collected from the steel sheet for hot stamp along a direction perpendicular to the rolling direction, and a tensile test was conducted at a tensile speed of 10 mm/min to obtain a tensile strength. Table 3 shows the observation results of the metallographic structure of the steel sheet for hot stamp and the examination results of the mechanical properties of the steel sheet for hot stamp.

TABLE 3

| Test No. | Steel | Kind of steel#1 | Kind of coating#2 | Metallographic structure of steel sheet for hot stamp $[Mn]_\theta + [Cr]_\theta$ (at %) | Mechanical properties of steel sheet for hot stamp Tensile strength (MPa) |
|---|---|---|---|---|---|
| 1 | A | CR | — | 5.9 | 541 |
| 2 | A | ACR | GA | 6.3 | 363 |
| 3 | A | AHR | — | 5.9 | 289 |
| 4 | A | CR | — | 5.9 | 541 |
| 5 | A | CR | — | 5.9 | 541 |
| 6 | A | CR | — | 5.9 | 541 |
| 7 | B | CR | — | 5.8 | 553 |
| 8 | B | ACR | AL | 6.5 | 343 |
| 9 | B | CR | — | 5.8 | 553 |
| 10 | B | CR | — | 5.8 | 553 |
| 11 | C | CR | — | 5.8 | 608 |
| 12 | C | ACR | AL | 6.4 | 353 |
| 13 | C | CR | — | 5.8 | 608 |
| 14 | C | CR | — | 5.8 | 608 |
| 15 | D | ACR | GA | 3.8 | 346 |
| 16 | E | CR | — | 5.8 | 602 |
| 17 | F | CR | — | 5.2 | 619 |
| 18 | G | CR | — | 1.3 | 558 |
| 19 | H | ACR | — | 6.4 | 352 |
| 20 | I | ACR | GA | 6.2 | 367 |
| 21 | J | CR | — | 5.7 | 542 |
| 22 | K | CR | — | 5.8 | 544 |

TABLE 3-continued

| Test No. | Steel | Kind of steel[#1] | Kind of coating[#2] | Metallographic structure of steel sheet for hot stamp $[Mn]_\theta + [Cr]_\theta$ (at %) | Mechanical properties of steel sheet for hot stamp Tensile strength (MPa) |
|---|---|---|---|---|---|
| 23 | L | ACR | GI | 6.1 | 358 |
| 24 | M | CR | — | 2.4 | 674 |
| 25 | M | CR | — | 9.4 | 642 |
| 26 | N | CR | — | 0.9 | 553 |
| 27 | N | CR | — | 3.0 | 550 |
| 28 | O | ACR | GA | 1.9 | 378 |
| 29 | O | ACR | GA | 3.5 | 371 |
| 30 | P | ACR | AL | 0.9 | 373 |
| 31 | P | ACR | AL | 3.1 | 359 |
| 32 | Q | CR | — | 1.2 | 556 |
| 33 | Q | CR | — | 3.2 | 551 |
| 34 | R | CR | — | 1.0 | 548 |
| 35 | R | CR | — | 2.8 | 545 |

[#1]HR: hot rolled steel sheet, AHR: hot-band annealed steel sheet, CR: cold-rolled steel sheet, ACR: annealed steel sheet
[#2]GI: hot-dip galvanized steel sheet, GA: hot-dip galvannealed steel sheet, AL: hot-dip aluminum-coated steel sheet, —: non-coated steel sheet A base steel sheet for hot stamp having a width of 240 mm and a length of 170 mm was taken from the steel sheet for hot stamp, and a hat member having the shape shown in FIG. 1 was manufactured by hot stamping. In the hot stamping process, the base steel sheet was heated at the heating temperature shown in Table 4 for four minutes using a gas heating furnace, thereafter taken out of the heating furnace and subjected to air cooling, and sandwiched between dies provided with a cooling device to be subjected to hat forming at the start temperature shown in Table 4.

A part of the obtained hat member (hot stamped product) was subjected to a heat treatment at 170° C. for 20 minutes using an electric heating furnace.

A test piece for SEM observation was collected from a punch bottom portion of the hat member before the heat treatment, a longitudinal section of the test piece parallel to the rolling direction of the steel sheet was polished, and thereafter the longitudinal section was subjected to nital etching and LePera etching. In a case of a non-coated steel sheet, at a ¼ depth position of the sheet thickness of the steel sheet from the surface of the steel sheet, and in a case of a coated steel sheet, at a ¼ depth position of the sheet thickness of the steel sheet as the substrate from the boundary between the steel sheet as the substrate and the coating layer, the metallographic structure was observed. The area ratios of ferrite, martensite, bainite, and pearlite were measured by image processing, and these were used as volume percentages. More specifically, the polished section was etched with nital, microstructure observation was performed using an optical microscope and a scanning electron microscope (SEM), and image analysis was performed on the obtained microstructure photograph, whereby the area ratio of each of ferrite and pearlite, and the total area ratio of bainite, martensite, and residual austenite were obtained. Thereafter, LePera etching was applied to the same observation position, microstructure observation was then performed using the optical microscope and the scanning electron microscope (SEM), and image analysis was performed on the obtained microstructure photograph, whereby the total area ratio of residual austenite and martensite was calculated. In addition, regarding the same observation position, the longitudinal section was subjected to electrolytic polishing, and then the area ratio of residual austenite was measured using SEM provided with an electron beam backscattering pattern analyzer (EBSP). Based on these results, the area ratio of each of ferrite, pearlite, bainite, martensite, and residual austenite was obtained. The area ratio was regarded as being the same as the volume percentage, so that the measured area ratio was regarded as the volume percentage of each microstructure. Table 4 shows the results. In the table, in test numbers satisfying the regulations of the present invention, the proportion of polygonal ferrite in ferrite in the metallographic structure of the hot stamped product was 10.0% or more.

Furthermore, a JIS No. 13 B tensile test piece was collected from a punch bottom portion of the hat member before and after the heat treatment along the longitudinal direction of the member, and a tensile test was conducted at a tensile speed of 10 mm/min to obtain a tensile strength. The difference (ΔTS) between the tensile strength of the hat member not subjected to the heat treatment and the tensile strength of the hat member subjected to the heat treatment was obtained, and when ΔTS was 100 MPa or less, the thermal stability of the hat member was determined to be good.

Table 4 shows the observation results of the metallographic structure of the hat member and the evaluation results of the mechanical properties of the hat member. In Table 4, underlined numerical values mean outside the range of the present invention.

TABLE 4

| | | Hot stamping condition | | Metallographic structure of hot stamped product | | | | Mechanical properties of hot stamped product | | |
|---|---|---|---|---|---|---|---|---|---|---|
| Test No. | Steel | Heating temperature (° C.) | Start temperature (° C.) | Volume percentage of ferrite (%) | Volume percentage of martensite (%) | Volume percentage of bainite (%) | Volume percentage of pearlite (%) | Tensile strength before heat treatment (MPa) | Tensile strength after heat treatment (MPa) | ΔTS (MPa) |
| 1 | A | 950 | 850 | 85.5 | 0.7 | 4.5 | 8.4 | 510 | 502 | 8 |
| 2 | A | 950 | 850 | 84.9 | 0.8 | 4.3 | 8.9 | 502 | 498 | 4 |
| 3 | A | 950 | 850 | 86.5 | 0.2 | 3.7 | 7.7 | 492 | 482 | 10 |
| 4 | A | 950 | 750 | 89.2 | 1.6 | 4.2 | 4.1 | 535 | 512 | 23 |
| 5 | A | 950 | 600 | 92.1 | <0.1 | <0.1 | 6.2 | 436 | 423 | 13 |
| 6 | A | 700 | 600 | 89.2 | <0.1 | <0.1 | 8.8 | 403 | 399 | 4 |
| 7 | B | 950 | 850 | 85.4 | 0.6 | 4.3 | 8.8 | 500 | 494 | 6 |
| 8 | B | 950 | 850 | 85.6 | 0.7 | 4.2 | 8.8 | 493 | 486 | 7 |
| 9 | B | 950 | 750 | 89.3 | 1.8 | 4.0 | 4.1 | 520 | 502 | 18 |
| 10 | B | 950 | 600 | 92.4 | <0.1 | <0.1 | 5.8 | 423 | 411 | 12 |
| 11 | C | 950 | 850 | 86.6 | 0.7 | 3.3 | 8.3 | 507 | 501 | 6 |
| 12 | C | 950 | 850 | 86.3 | 0.8 | 3.4 | 8.6 | 502 | 494 | 8 |

TABLE 4-continued

| Test No. | Steel | Hot stamping condition: Heating temperature (° C.) | Hot stamping condition: Start temperature (° C.) | Metallographic structure of hot stamped product: Volume percentage of ferrite (%) | Volume percentage of martensite (%) | Volume percentage of bainite (%) | Volume percentage of pearlite (%) | Mechanical properties of hot stamped product: Tensile strength before heat treatment (MPa) | Tensile strength after heat treatment (MPa) | ΔTS (MPa) |
|---|---|---|---|---|---|---|---|---|---|---|
| 13 | C | 950 | 750 | 89.4 | 1.9 | 3.7 | 4.2 | 530 | 507 | 23 |
| 14 | C | 950 | 600 | 93.0 | <0.1 | <0.1 | 4.9 | 427 | 417 | 10 |
| 15 | D | 950 | 850 | 88.1 | 0.3 | 3.2 | 7.2 | 491 | 465 | 26 |
| 16 | E | 950 | 750 | 82.0 | 10.3 | 4.8 | 2.0 | 833 | 642 | 191 |
| 17 | F | 950 | 750 | 80.3 | 8.9 | 7.7 | 1.9 | 765 | 587 | 178 |
| 18 | G | 950 | 750 | 86.2 | <0.1 | 4.6 | 8.2 | 713 | 602 | 111 |
| 19 | H | 950 | 850 | 81.0 | 4.1 | 11.1 | 2.6 | 555 | 527 | 28 |
| 20 | I | 950 | 850 | 82.9 | 2.4 | 8.9 | 4.6 | 542 | 527 | 15 |
| 21 | J | 950 | 850 | 85.1 | 0.8 | 4.5 | 8.6 | 524 | 518 | 6 |
| 22 | K | 950 | 850 | 86.2 | 0.6 | 3.6 | 8.4 | 522 | 513 | 9 |
| 23 | L | 950 | 850 | 85.8 | 0.7 | 3.9 | 8.8 | 523 | 517 | 6 |
| 24 | M | 950 | 750 | 79.3 | 14.0 | 2.3 | 0.9 | 724 | 521 | 203 |
| 25 | M | 950 | 770 | 58.8 | 26.4 | 11.0 | 0.4 | 703 | 532 | 171 |
| 26 | N | 950 | 750 | 90.1 | 1.5 | 3.6 | 4.0 | 622 | 510 | 112 |
| 27 | N | 950 | 750 | 90.6 | 1.4 | 3.3 | 3.6 | 592 | 504 | 88 |
| 28 | O | 950 | 750 | 88.7 | 1.9 | 4.0 | 4.4 | 613 | 508 | 105 |
| 29 | O | 950 | 750 | 89.2 | 1.6 | 3.7 | 4.2 | 584 | 505 | 79 |
| 30 | P | 950 | 750 | 90.3 | 1.5 | 3.6 | 3.9 | 618 | 516 | 102 |
| 31 | P | 950 | 750 | 90.7 | 1.2 | 3.6 | 3.5 | 591 | 511 | 80 |
| 32 | Q | 950 | 750 | 89.7 | 1.8 | 4.0 | 3.7 | 638 | 515 | 123 |
| 33 | Q | 950 | 750 | 90.3 | 1.4 | 3.5 | 3.6 | 616 | 512 | 104 |
| 34 | R | 950 | 750 | 90.9 | 1.4 | 3.1 | 4.0 | 637 | 507 | 130 |
| 35 | R | 950 | 750 | 91.3 | 1.2 | 2.3 | 4.2 | 610 | 503 | 107 |

In all of Test Nos. 1 to 15, 19 to 23, 27, 29, and 31 satisfying the regulations of the present invention, TS of the hot stamped product was less than 700 MPa, ΔTS was 100 MPa or less, and good thermal stability was shown.

In addition, in Test Nos. 1 to 4, 7 to 9, 11 to 13, 15, 19 to 23, 27, 29, and 31 in which heating to a temperature higher than the $Ac_1$ point was performed in the hot stamping process and the hot stamping start temperature was (heating temperature−300°) C. or higher, the tensile strength of the hot stamped product was 440 MPa or more, and the strength properties were particularly good.

Contrary to these tests, in Test Nos. 16 to 18, 24 to 26, 28, 30, and 32 to 35 of comparative examples using steel sheets with chemical compositions deviating from the range of the present invention and/or comparative examples in which the steel sheets for hot stamp used did not have a preferable microstructure, the hot stamped product had a TS of 700 MPa or more and a ΔTS of 100 MPa or more, or had a ΔTS of 100 MPa or more and poor thermal stability.

Specifically, in Test No. 16 using Steel E, since the C content of the steel was too high, the volume percentage of martensite in the metallographic structure of the hot stamped product was excessive, the tensile strength of the hot stamped product was 700 MPa or more, and ΔTS was large.

In Test No. 17 using Steel F, the Mn content of the steel was too high, so that the tensile strength of the hot stamped product was 700 MPa or more and ΔTS was large.

In Test No. 18 using Steel G, the Cr content of the steel was too low, so that the tensile strength of the hot stamped product was 700 MPa or more and ΔTS was large.

In Test Nos. 24 and 25 using Steel M, the Cr content of the steel was too high, so that the volume percentage of martensite in the metallographic structure of the hot stamped product was excessive, the tensile strength of the hot stamped product was 700 MPa or more, and ΔTS was large.

In Test Nos. 32 and 33 using Steel Q, the Mn content of the steel was too high, so that ΔTS was large.

In Test Nos. 34 and 35 using Steel R, the Cr content of the steel was too high, so that ΔTS was large.

In Test Nos. 26, 28, and 30 of comparative examples using steel sheets in which the chemical composition was within the range of the present invention but the metallographic structure of the steel sheet for hot stamp deviated from the range of the present invention, ΔTS of the hot stamped product was 100 MPa or more, and the thermal stability was poor.

Specifically, in Test No. 26 using Steel N and Test No. 30 using Steel P, since hot-band annealing was not performed, the sum of the Mn content and the Cr content in iron carbides in the metallographic structure of the steel sheet for hot stamp was low, and ΔTS was large.

In Test No. 28 using Steel 0, the heating temperature in the hot-band annealing process was too low, so that the sum of the Mn content and the Cr content in iron carbides in the metallographic structure of the steel sheet for hot stamp was low, and ΔTS was large.

Example 2

Molten steel was cast using a vacuum melting furnace to manufacture Steels A to C having the chemical composition shown in Table 1 in Example 1. Using Steels A to C, in the same manner as in Example 1, under the conditions shown in Table 5, hot rolling, hot-band annealing, cold rolling, and annealing were performed, and a coating treatment was thereafter performed, whereby a hot-dip galvanized steel sheet, a hot-dip galvannealed steel sheet, and a hot-dip aluminum-coated steel sheet (steel sheet for hot stamp) were manufactured.

TABLE 5

| Test No. | Steel | Hot rolling condition: Plate thickness after rolling (mm) | Hot rolling condition: Coiling temperature (° C.) | Hot-band annealing condition Soaking temperature (° C.) | Cold rolling condition: Sheet thickness after rolling (mm) | Cold rolling condition: Annealing condition Soaking temperature (° C.) |
|---|---|---|---|---|---|---|
| 36 | A | 3.6 | 540 | 710 | 1.4 | 740 |
| 37 | B | 3.6 | 540 | 710 | 1.4 | 730 |
| 38 | C | 3.6 | 540 | 710 | 1.4 | 730 |

The metallographic structure and mechanical properties of these steel sheets for hot stamp were examined in the same manner as in Example 1. Table 6 shows the observation results of the metallographic structure of the steel sheet for hot stamp and the examination results of the mechanical properties of the steel sheet for hot stamp.

TABLE 6

| Test No. | Steel | Kind of steel[#3] | Kind of coating[#4] | Metallographic structure of steel sheet for hot stamp $[Mn]_\theta + [Cr]_\theta$ (at %) | Mechanical properties of steel sheet for hot stamp Tensile strength (MPa) |
|---|---|---|---|---|---|
| 36 | A | ACR | AL | 6.5 | 348 |
| 37 | B | ACR | GI | 6.2 | 352 |
| 38 | C | ACR | GA | 6.3 | 360 |

[#3]ACR: annealed steel sheet
[#4]GI: hot-dip galvanized steel sheet, GA: hot-dip galvannealed steel sheet, AL: hot-dip aluminum-coated steel sheet From these steel sheets for hot stamp, a base steel sheet for hot stamp having a thickness of 1.4 mm, a width of 240 mm, and a length of 170 mm was taken. This base steel sheet was joined to a steel sheet for joining having the same dimensions by laser welding to manufacture a joined steel sheet having a thickness of 1.4 mm, a width of 240 mm, and a length of 340 mm. As the steel sheet for joining, a cold-rolled steel sheet containing, as a chemical composition, by mass %, 0.21% of C, 0.13% of Si, 1.31% of Mn, 0.012% of P, 0.0018% of S, 0.043% of sol.Al, 0.0030% of N, 0.21% of Cr, and 0.0018% of B was used.

Figure 2:
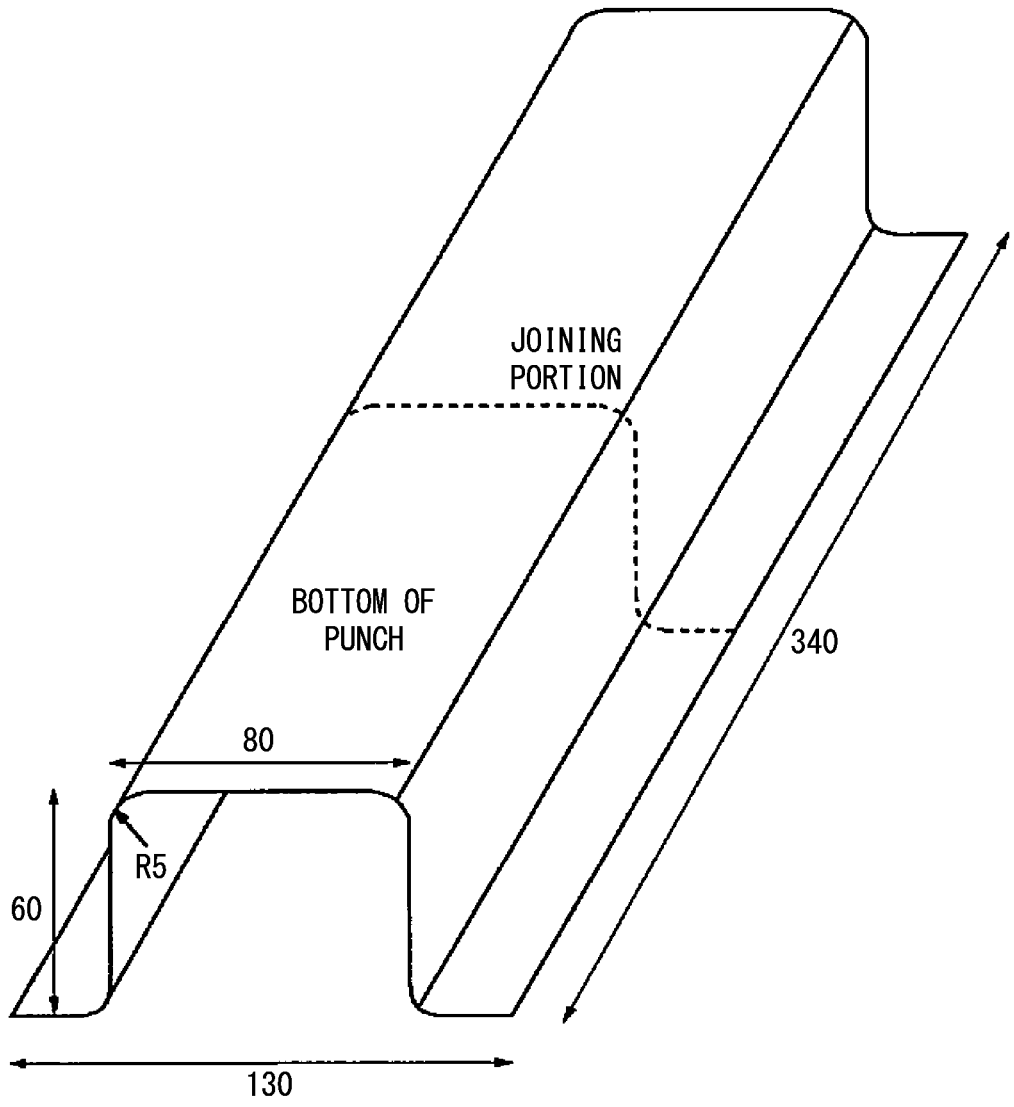
FIG. 2 is a schematic view showing the shape of a hot stamped product manufactured in Example 2.

The joined steel sheet was hot stamped in the same manner as in Example 1 under the conditions shown in Table 7, whereby a hat member having the shape shown in FIG. 2 was manufactured. Thereafter, a part of the obtained hat member was subjected to a heat treatment at 170° C. for 20 minutes using an electric heating furnace.

Then, in the hat member before and after the heat treatment, the metallographic structure and mechanical properties of portions made of Steels A to C were examined in the same manner as in Example 1. Table 7 shows the observation results of the metallographic structure of the hat member (hot stamped product) and the evaluation results of the mechanical properties of the hat member.

TABLE 7

| Test No. | Steel | Hot stamping condition: Heating temperature (° C.) | Hot stamping condition: Start temperature (° C.) | Metallographic structure of hot stamped product: Volume percentage of ferrite (%) | Volume percentage of martensite (%) | Volume percentage of bainite (%) | Volume percentage of pearlite (%) | Mechanical properties of hot stamped product: Tensile strength before heat treatment (MPa) | Tensile strength after heat treatment (MPa) | ΔTS (MPa) |
|---|---|---|---|---|---|---|---|---|---|---|
| 36 | A | 900 | 800 | 89.0 | 1.3 | 3.7 | 4.8 | 525 | 509 | 16 |
| 37 | B | 900 | 800 | 89.3 | 1.3 | 3.7 | 4.6 | 515 | 502 | 13 |
| 38 | C | 900 | 800 | 89.5 | 1.2 | 3.6 | 4.4 | 523 | 505 | 18 |

In any test results of Test Nos. 36 to 38, TS of the hot stamped product was less than 700 MPa, ΔTS was 100 MPa or less, and good thermal stability was exhibited. The metallographic structure of the part of the steel sheet for joining of the hat member was a single martensite microstructure, and the tensile strength was 1588 MPa.

INDUSTRIAL APPLICABILITY

According to the present invention, it is possible to obtain a hot stamped product which has a portion with small strength fluctuation caused by a coating baking treatment and a tensile strength of less than 700 MPa and is thus excellent in thermal stability.

What is claimed is:

1. A hot stamped product, an entirety or a part of the hot stamped product comprising, as a chemical composition, by mass %:

C: 0.001% or more and less than 0.080%;
Si: 2.50% or less;
Mn: 0.01% or more and less than 0.50%;
P: 0.200% or less;
S: 0.0200% or less;
sol.Al: 0.001% to 2.500%;
N: 0.0200% or less;
Cr: 0.30% or more and less than 2.00%;
Ti: 0% to 0.300%;
Nb: 0% to 0.300%;
V: 0% to 0.300%;
Zr: 0% to 0.300%;
Mo: 0% to 2.00%;
Cu: 0% to 2.00%;

Ni: 0% to 2.00%;
B: 0% to 0.0200%;
Ca: 0% to 0.0100%;
Mg: 0% to 0.0100%;
REM: 0% to 0.1000%;
Bi: 0% to 0.0500%; and
a remainder: Fe and impurities,
wherein a metallographic structure contains, by vol %,
ferrite: more than 60.0%,
martensite: 0% or more and less than 10.0%, and
bainite: 0% or more and less than 20.0%,
a tensile strength is less than 700 MPa, and
ΔTS, which is a decrease in the tensile strength after a heat treatment at 170° C. for 20 minutes, is 100 MPa or less.

2. The hot stamped product according to claim 1,
wherein the chemical composition contains, by mass %, one or more selected from the group consisting of:
Ti: 0.001% to 0.300%;
Nb: 0.001% to 0.300%;
V: 0.001% to 0.300%;
Zr: 0.001% to 0.300%,
Mo: 0.001% to 2.00%;
Cu: 0.001% to 2.00%;
Ni: 0.001% to 2.00%;
B: 0.0001% to 0.0200%;
Ca: 0.0001% to 0.0100%;
Mg: 0,0001% to 0.0100%;
REM: 0.0001% to 0.1000%; and
Bi: 0.0001% to 0.0500%.

3. The hot stamped product according to claim 1, further comprising:
a coating layer on a surface.

4. A steel sheet for hot stamp for use in manufacturing the hot stamped steel product according to claim 1, comprising, as a chemical composition, by mass %:
C: 0.001% or more and less than 0.080%;
Si: 2.50% or less;
Mn: 0.01% or more and less than 0.50%;
P: 0.200% or less;
S: 0.0200% or less;
0.001 to 2.500%;
N: 0.0200% or less;
Cr: 0.30% or more and less than 2.00%;
Ti: 0% to 0.300%;
Nb: 0% to 0.300%;
V: 0% to 0.300%;
Zr: 0% to 0.300%;
Mo: 0% to 2.00%;
Cu: 0% to 2.00%;
Ni: 0% to 2.00%;
B: 0% to 0.0200%;
Ca: 0% to 0.0100%;
Mg: 0% to 0.0100%;
REM: 0% to 0.1000%;
Bi: 0% to 0.0500%; and
a remainder: Fe and impurities,
wherein a metallographic structure contains iron carbides, and a Mn content and a Cr content in the iron carbides satisfy Formula (i):

$$[Mn]_\theta+[Cr]_\theta>2.5 \quad (i)$$

where meaning of each symbol in the formula is as follows:
$[Mn]_\theta$: the Mn content, in unit at %, in the iron carbides when a total amount of Fe, Mn, and Cr contained in the iron carbides is 100 at %; and
$[Cr]_\theta$: the Cr content, in unit at %, in the iron carbides when the total amount of Fe, Mn, and Cr contained in the iron carbides is 100 at %.

5. The steel sheet for hot stamp according to claim 4,
wherein the chemical composition contains, by mass %, one or more selected from the group consisting of:
Ti: 0.001% to 0.300%;
Nb: 0.001% to 0.300%;
V: 0.001% to 0.300%;
Zr: 0.001% to 0.300%;
Mo: 0.001% to 2.00%;
Cu: 0.001% to 2.00%;
Ni: 0.001% to 2.00%;
B: 0.0001% to 0.0200%;
Ca: 0.0001% to 0.0100%;
Mg: 0.0001% to 0.0100%;
REM: 0.0001% to 0.1000%; and
Bi: 0.0001% to 0.0500%.

6. The steel sheet for hot stamp according to claim 4, further comprising:
a coating layer on a surface.

7. A manufacturing method of the hot stamped product according to claim 1, the method comprising:
a heating process of heating a steel sheet for hot stamp comprising, as a chemical composition, by mass %:
C: 0.001% or more and less than 0.080%;
Si: 2.50% or less;
Mn: 0.01% or more and less than 0.50%;
P: 0.200% or less;
S: 0.0200% or less;
sol.Al: 0.001 to 2.500%;
N: 0.0200% or less;
Cr: 0.30% or more and less than 200%;
Ti: 0% to 0.300%;
Nb: 0% to 0.300%;
V: 0% to 0.300%;
Zr: 0% to 0.300%;
Mo: 0% to 2.00%;
Cu: 0% to 2.00%;
Ni: 0% to 2.00%;
B: 0% to 0.0200%;
Ca: 0% to 0.0100%;
Mg: 0% to 0.0100%;
REM: 0% to 0.1000%;
Bi: 0% to 0.0500%; and
a remainder: Fe and impurities,
wherein a metallographic structure contains iron carbides, and a Mn content and a Cr content in the iron carbides satisfy Formula (i):

$$[Mn]_\theta+[Cr]_\theta>2.5 \quad (i)$$

where meaning of each symbol in the formula is as follows:
$[Mn]_\theta$: the Mn content, in unit at %, in the iron carbides when a total amount of Fe, Mn, and Cr contained in the iron carbides is 100 at %; and
$[Cr]_\theta$: the Cr content, in unit at %, in the iron carbides when the total amount of Fe, Mn, and Cr contained in the iron carbides is 100 at %,
to a heating temperature T° C.; and
a hot stamping process of performing hot stamping on the steel sheet for hot stamp after the heating process.

8. A manufacturing method of the hot stamped product according to claim 1, the method comprising:
a joining process of joining a steel sheet for hot stamp comprising, as a chemical composition, by mass %:
C: 0.001% or more and less than 0.080%;

Si: 2.50% or less;
Mn: 0.01% or more and less than 0.50%;
P: 0.200% or less;
S: 0.0200% or less;
sol.Al: 0.001 to 2.500%;
N: 0.0200% or less;
Cr: 0.30% or more and less than 2.00%;
Ti: 0% to 0.300%;
Nb: 0% to 0.300%;
V: 0% to 0.300%;
Zr: 0% to 0.300%;
Mo: 0% to 2.00%;
Cu: 0% to 2.00%;
Ni: 0% to 2.00%;
B: 0% to 0.0200%;
Ca: 0% to 0.0100%;
Mg: 0% to 0.0100%;
REM: 0% to 0.1000%;
Bi: 0% to 0.0500%; and
a remainder: Fe and impurities,
wherein a metallographic structure contains iron carbides, and a Mn content and a Cr content in the iron carbides satisfy Formula (i):

$$[Mn]_\theta+[Cr]_\theta>2.5 \quad (i)$$

where meaning of each symbol in the formula is as follows:
$[Mn]_\theta$: the Mn content, in unit at %, in the iron carbides when a total amount of Fe, Mn, and Cr contained in the iron carbides is 100 at %; and
$[Cr]_\theta$: the Cr content, in unit at %, in the iron carbides when the total amount of Fe, Mn, and Cr contained in the iron carbides is 100 at %,
to a steel sheet for joining to form a joined steel sheet;
a heating process of heating the joined steel sheet after the joining process to a heating temperature T° C.; and
a hot stamping process of performing hot stamping on the joined steel sheet after the heating process.

9. A manufacturing method of the hot stamped product according to claim 3, the method comprising:
a heating process of heating a steel sheet for hot stamp comprising, as a chemical composition, by mass %:
C: 0.001% or more and less than 0.080%;
Si: 2.50% or less;
Mn: 0.01% or more and less than 0.50%;
P: 0.200% or less;
S: 0.0200% or less;
sol.Al: 0.001 to 2.500%;
N: 0.0200% or less;
Cr: 0.30% or more and less than 2.00%;
Ti: 0% to 0.300%;
Nb: 0% to 0.300%;
V: 0% to 0.300%;
Zr: 0% to 0.300%;
Mo: 0% to 2.00%;
Cu: 0% to 2.00%;
Ni: 0% to 2.00%;
B: 0% to 0.0200%;
Ca: 0% to 0.0100%;
Mg: 0% to 0.0100%;
REM: 0% to 0.1000%;
Bi: 0% to 0.0500%; and
a remainder: Fe and impurities,
wherein a metallographic structure contains iron carbides, and a Mn content and a Cr content in the iron carbides satisfy Formula (i):

$$[Mn]_\theta+[Cr]_\theta>2.5 \quad (i)$$

where meaning of each symbol in the formula is as follows:
$[Mn]_\theta$: the Mn content, in unit at %, in the iron carbides when a total amount of Fe, Mn, and Cr contained in the iron carbides is 100 at %; and
$[Cr]_\theta$: the Cr content, in unit at %, in the iron carbides when the total amount of Mn, and Cr contained in the iron carbides is 100 at %, and
the steel sheet for hot stamp further comprising:
a coating layer on a surface,
to a heating temperature T° C.; and
a hot stamping process of performing hot stamping on the steel sheet after the heating process.

10. A manufacturing method of the hot stamped product according to claim 3, the method comprising:
a joining process of joining a steel sheet for hot stamp comprising, as a chemical composition, by mass %:
C: 0.001% or more and less than 0.080%;
Si: 2.50% or less;
Mn: 0.01% or more and less than 0.50%;
P: 0.200% or less;
S: 0.0200% or less;
sol.Al: 0.001 to 2.500%;
N: 0.0200% or less;
Cr: 0.30% or more and less than 2.00%;
Ti: 0% to 0.300%;
Nb: 0% to 0.300%;
V: 0% to 0.300%;
Zr: 0% to 0.300%;
Mo: 0% to 2.00%;
Cu: 0% to 2.00%;
Ni: 0% to 2.00%;
B: 0% to 0.0200%;
Ca: 0% to 0.0100%;
Mg: 0% to 0.0100%;
REM: 0% to 0.1000%;
Bi: 0% to 0.0500%; and
a remainder: Fe and impurities,
wherein a metallographic structure contains iron carbides, and a Mn content and a Cr content in the iron carbides satisfy Formula (i):

$$[Mn]_\theta+[Cr]_\theta>2.5 \quad (i)$$

where meaning of each symbol in the formula is as follows:
$[Mn]_\theta$: the Mn content, in unit at %, in the iron carbides when a total amount of Fe, Mn, and Cr contained in the iron carbides is 100 at %; and
$[Cr]_\theta$: the Cr content, in unit at %, in the iron carbides when the total amount of Fe, Mn, and Cr contained in the iron carbides is 100 at %, and
the steel sheet for hot stamp further comprising:
a coating layer on a surface,
to a steel sheet for joining, to form a joined steel sheet;
a heating process of heating the joined steel sheet after the joining process to a heating temperature T° C.; and
a hot stamping process of performing hot stamping on the joined steel sheet after the heating process.

11. The manufacturing method of the hot stamped product according to claim 7,
wherein, in the heating process, the heating temperature T° C. is a temperature higher than an $Ac_1$ point of the steel sheet for hot stamp, and
in the hot stamping process, a hot stamping start temperature is a temperature of (T−300)° C. or higher.

12. A manufacturing method of the steel sheet for hot stamp according to claim 4, the method comprising:

a hot rolling process of performing hot rolling on a slab containing, as a chemical composition, by mass %, C: 0.001% or more and less than 0.080%, Si: 2.50% or less, Mn: 0.01% or more and less than 0.50%, P: 0.200% or less, S: 0.0200% or less, sol.Al: 0.001% to 2.500%, N: 0.0200% or less, Cr: 0.30% or more and less than 2.00%, Ti: 0% to 0.300%, Nb: 0% to 0.300%, V: 0% to 0.300%, Zr: 0% to 0.300%, Mo: 0% to 2.00%, Cu: 0% to 2.00%, Ni: 0% to 2.00%, B: 0% to 0.0200%, Ca: 0% to 0.0100%, Mg: 0% to 0.0100%, REM: 0% to 0.1000%, Bi: 0% to 0.0500%, and a remainder: Fe and impurities, and performing coiling in a temperature range of 800° C. or lower to form a hot-rolled steel sheet; and a hot-band annealing process of performing hot-band annealing in which the hot-rolled steel sheet is heated to a temperature range of higher than 650° C. to form a hot-rolled annealed steel sheet.

13. The manufacturing method of the steel sheet for hot stamp according to claim 12, the method further comprising:

a coating process of performing coating after optionally performing either or both of cold rolling and annealing on the hot-rolled annealed steel sheet after the hot-band annealing process.

14. The manufacturing method of the hot stamped product according to claim 8, wherein, in the heating process, the heating temperature T° C. is a temperature higher than an $Ac_1$ point of the steel sheet for hot stamp, and in the hot stamping process, a hot stamping start temperature is a temperature of (T−300)° C. or higher.

15. The manufacturing method of the hot stamped product according to claim 9, wherein, in the heating process, the heating temperature T° C. is a temperature higher than an $Ac_1$ point of the steel sheet for hot stamp, and in the hot stamping process, a hot stamping start temperature is a temperature of (T−300)° C. or higher.

16. The manufacturing method of the hot stamped product according to claim 10, wherein, in the heating process, the heating temperature T° C. is a temperature higher than an $Ac_1$ point of the steel sheet for hot stamp, and in the hot stamping process, a hot stamping start temperature is a temperature of (T−300)° C. or higher.

* * * * *